US009381658B2

(12) United States Patent
Abe

(10) Patent No.: US 9,381,658 B2
(45) Date of Patent: Jul. 5, 2016

(54) SHEET PROCESSING APPARATUS AND IMAGE FORMING APPARATUS

(75) Inventor: Hideto Abe, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 1062 days.

(21) Appl. No.: 13/267,136

(22) Filed: Oct. 6, 2011

(65) Prior Publication Data

US 2012/0090441 A1 Apr. 19, 2012

(30) Foreign Application Priority Data

Oct. 14, 2010 (JP) ..... 2010-231498
Sep. 15, 2011 (JP) ..... 2011-201896

(51) Int. Cl.
*B26D 7/18* (2006.01)
*B26D 1/08* (2006.01)

(52) U.S. Cl.
CPC ..... *B26D 1/08* (2013.01); *B26D 7/1818* (2013.01); *Y10T 83/2096* (2015.04)

(58) Field of Classification Search
CPC ..... B26D 7/18; B26D 7/1809; B26D 7/1818; B26D 7/1881; B26D 7/1836; B26D 7/02; B26D 7/01; B26D 7/015; B26D 5/42; B41J 11/66; B41J 11/70; B41J 11/706; Y10T 83/2096; Y10T 83/2098; Y10T 83/9447; Y10T 83/9454; Y10T 83/5669; Y10T 83/5733; Y10T 83/5742; Y10T 83/5751; Y10T 83/576; Y10T 83/5769; Y10T 83/5787; Y10T 83/7487; Y10T 83/7493; Y10T 83/75
USPC ..... 83/111, 112, 694, 697, 375, 382–386, 83/388, 452–454
See application file for complete search history.

(56) References Cited

U.S. PATENT DOCUMENTS

| | | | |
|---|---|---|---|
| 6,633,733 | B2 | 10/2003 | Mochimaru et al. |
| 8,616,541 | B2 | 12/2013 | Hayashi |
| 2002/0051646 | A1 | 5/2002 | Mochimaru et al. |
| 2010/0007071 | A1 | 1/2010 | Hayashi |
| 2011/0140335 | A1 | 6/2011 | Abe |
| 2011/0176849 | A1 | 7/2011 | Abe |

FOREIGN PATENT DOCUMENTS

| | | | |
|---|---|---|---|
| CN | 1351285 | A | 5/2002 |
| CN | 101624149 | A | 1/2010 |
| JP | 62-61498 | U | 4/1987 |
| JP | 2-90090 | U | 7/1990 |
| JP | 2008-238394 | A | 10/2008 |
| JP | 2010-194709 | A | 9/2010 |
| JP | 2010-195582 | A | 9/2010 |
| JP | 4878381 | B2 | 2/2012 |
| JP | 5091265 | B2 | 12/2012 |

OTHER PUBLICATIONS

Office Action dated Jan. 20, 2014, in Chinese Patent Application No. 201110304986.8.

*Primary Examiner* — Phong Nguyen
(74) *Attorney, Agent, or Firm* — Fitzpatrick, Cella, Harper & Scinto

(57) ABSTRACT

A sheet processing apparatus and an image forming apparatus according to the present invention includes an upper blade capable of moving up and down and a lower blade to cut a sheet bundle between the upper blade and the lower blade by downward movement of the upper blade. When the sheet bundle is cut by the downward movement of the upper blade, an assisting sheet is moved to a position below a blade edge of the upper blade such that cutting waste of the cut sheet bundle is dropped down without being adhered to the lower blade.

17 Claims, 24 Drawing Sheets

SHEET PROCESSING APPARATUS AND IMAGE FORMING APPARATUS

BACKGROUND OF THE INVENTION

1. Field of the Invention

The present invention relates to a sheet processing apparatus and an image forming apparatus. More particularly, the present invention relates to a sheet processing apparatus which cuts an open end portion of a sheet bundle formed by bundling and folding sheets and to an image forming apparatus including the sheet processing apparatus.

2. Description of the Related Art

Some conventional image forming apparatuses such as copying machines and laser printers include sheet processing apparatuses. The sheet processing apparatus performs saddle stitch bookbinding by accepting sheets to be discharged and folding in the middle of the sheets or by accepting sheets, performing a binding process in a substantially middle portion of the sheets, and then folding in half at center of the sheets after images are formed on the sheets.

Conventionally, when a sheet bundle is folded and bound to form a saddle-stitched book (hereinafter called a booklet), an edge serving as an end (open end) on a side opposite to a binding portion of the booklet has been known to be shaped in a triangle with a pointed center in a thickness direction of the booklet. This triangle is unique to a booklet formed by the saddle stitch bookbinding, whereas a booklet formed by side stitch bookbinding, case work bookbinding, or tape bookbinding has a rectangular edge.

When pages of the booklet having such a triangular edge are turned, a next page protrudes from a current page among pages from a front cover to a vertex in a center of the booklet, so that the next page can be picked up with fingers and turned. Among pages from the vertex to a back cover of the booklet, however, a next page is retracted from a current page, and thus the next page cannot be picked up with fingers, causing difficulty in turning the page. On the other hand, when an edge has a rectangular shape, pages can be stably turned without differences in page turning.

Consequently, there are cases where an edge portion of a booklet is cut (sheared) by a cutting process to eliminate the triangular edge unique to the saddle stitch bookbinding. Cutting apparatuses (trimmers) for such a cutting process have been commonly known in the art. For example, Japanese Patent Laid-Open No. 2008-238394 discusses a cutting apparatus that includes a movable blade (upper blade) capable of moving up and down and a fixed blade (lower blade) fixed in a position below the movable blade such that an edge portion of a booklet is nipped between the movable blade and the fixed blade by moving down the movable blade and is cut. Accordingly, the cutting of the edge portion of the booklet can change the edge shape from triangle to rectangle, thereby enhancing the appearance of the booklet as a product and proving stability in page turning.

In such a conventional sheet processing apparatus, when the edge portion of the booklet is nipped between the movable blade having moved down and the fixed blade and is cut, waste generated by cutting the edge portion (hereinafter called cutting waste) is pushed down along a side surface of the fixed blade in a state of being in contact with the movable blade. Subsequently, the cutting waste is dropped into a waste box arranged below the fixed blade.

However, for example, when a booklet includes sheets output from an image forming apparatus that forms images using electrophotography such as static electricity, cutting waste scrap may be adhered to a movable blade due to charged sheets. When such the cutting waste is adhered to the movable blade, the cutting waste is moved up with an upward movement of the movable blade without being dropped into a waste box, causing the cutting waste scrap to adhere to and remain on an upper surface of the fixed blade.

Since the upper surface of the fixed blade serves as a conveying surface for conveying sheets, the cutting waste adhered to the upper surface of the fixed blade is conveyed to a downstream side with the following sheet. Consequently, there have been cases where the cutting apparatus stops for emergency when such conveyed cutting waste is detected by a sensor which detects a sheet. Moreover, the cutting waste conveyed with the sheets is stacked and held with the booklet, causing the possibility of deterioration in booklet quality.

The present invention provides a sheet processing apparatus and an image forming apparatus capable of reducing occurrences of adhesion of cutting waste to a fixed blade.

SUMMARY OF THE INVENTION

According to an aspect of the present invention, a sheet processing apparatus which performs a cutting process cutting a sheet bundle includes a fixed blade, a movable blade, capable of moving up and down, which is disposed above the fixed blade and cuts the sheet bundle between the movable blade and the fixed blade in conjunction with the fixed blade, and an adhesion preventing member which moves down along a side of the fixed blade to a position below a blade edge of the movable blade after the movable blade cuts the sheet bundle.

According to the aspect of the present invention, the adhesion preventing member is moved down to a position below the blade edge of the movable blade when the sheet bundle is cut by the movable blade, thereby reducing occurrences of adhesion of the cutting waste to the fixed blade disposed below the movable blade.

Further features of the present invention will become apparent from the following description of exemplary embodiments with reference to the attached drawings.

DESCRIPTION OF THE EMBODIMENTS

Figure 1:
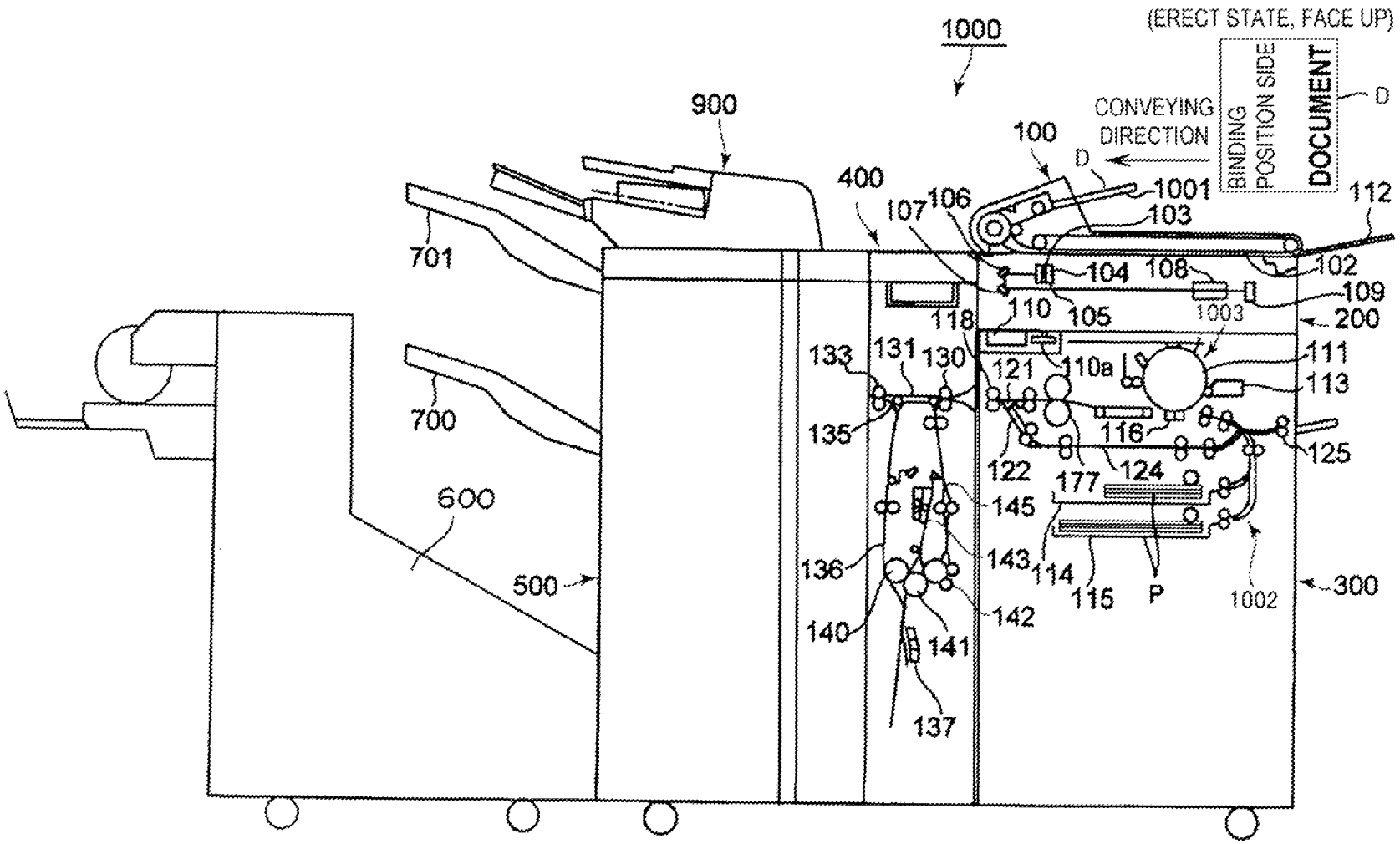
FIG. 1 illustrates a cross-sectional view of a copying machine as an example of an image forming apparatus including a sheet processing apparatus according to a first embodiment of the present invention.

Embodiments of the present invention are described below with reference to the drawings. FIG. 1 illustrates a cross-sectional view of a copying machine 1000 as an example of an image forming apparatus including a sheet processing apparatus according to a first embodiment of the present invention. The copying machine 1000 includes a copy machine main body 300 and a scanner 200 disposed on an upper surface of the copying machine main body 300.

The scanner 200 for reading a document includes a document feeding portion 100, a scanner unit 104, a lens 108, and an image sensor 109. When a document D is read by the scanner 200, the document D is first set on a tray 1001 of the document feeding portion 100. Herein, assume the document D is set on the tray 1001 in an erect state when observed from a user and in a face-up state (surface having image formed thereon is up). Assume the document D has a binding position arranged in a left end portion thereof.

Next, the document D is conveyed sheet by sheet from a leading page of the sheet toward a left direction (arrow direction in the drawing) by the document feeding portion 100, that is, the binding position of each page is conveyed as a leading end. Then, each sheet is conveyed on a platen glass 102 from a left direction to a right direction through a curved path and is discharged onto a discharge tray 112. Herein, when a reading process called flow reading for reading a document is used, the scanner unit 104 is held in a predetermined position while each sheet of the document D is passing from left to right on the scanner unit 104.

In such a reading process, when each sheet of the document D passes on the platen glass 102, a lamp 103 of the scanner unit 104 irradiates the sheet with light, so that reflected light is guided to an image sensor 109 via mirrors 105, 106, and 107, and a lens 108. Image data of the document D read by the image sensor 109 undergoes a predetermined image process and are transmitted to an exposure controlling portion 110.

When a reading process called fixed reading is used, on the other hand, each sheet of the document D conveyed from the document feeding portion 100 once stops on the platen glass 102, so that the scanner unit 104 is moved from left to right to read the document D. Moreover, when a document is read without using the document feeding portion 100, a user lifts up the document feeding portion 100 and sets the document on the platen glass 102.

The copying machine main body 300 includes a sheet feeding portion 1002 that feeds a sheet P stored in cassettes 114 or 115, and an image forming portion 1003 that forms an image on the sheet P fed by the sheet feeding portion 1002.

The image forming portion 1003 includes a photosensitive drum 111, a development device 113, and a transfer charger 116. When an image is formed, the exposure controlling portion 110 irradiates the photosensitive drum 111 with laser beams to form a latent image on the photosensitive drum 111, and the latent image is visualized as a toner image by the development device 113. A fixing portion 117 and a pair of discharge rollers 118 are disposed on a downstream side in a sheet conveying direction of the image forming portion 1003.

The image forming operation of the copying machine main body 300 is now described. In a process such as the flow reading and the fixed reading by the scanner 200 as described above, the image data of the document D read by the image sensor 109 are transmitted to the exposure controlling portion 110 after undergoing the predetermined image process. The exposure controlling portion 110 outputs a laser beam corresponding to an image signal, and the laser beam is irradiated on the photosensitive drum 111 while being scanned by a polygon mirror 110*a*, so that an electrostatic latent image corresponding to the scanned laser beam is formed on the photosensitive drum 111. Subsequently, the electrostatic latent image formed on the photosensitive drum 111 is developed and visualized as a toner image by the development device 113.

The sheet P, on the other hand, is conveyed from any of the cassettes 114 and 115, a manual feeding portion 125, and a duplex conveying path 124 to a transfer portion including the photosensitive drum 111 and the transfer charger 116. The visualized toner image on the photosensitive drum 111 is transferred to the sheet P in the transfer portion, and the sheet P having the transferred image thereon undergoes a fixing process in the fixing portion 117.

Subsequently, the sheet P having passed the fixing portion 117 is once guided to a path 122 by a switching member (not illustrated). When a tail end of the sheet P in the conveying direction passes through the switching member, the sheet P is switched back and conveyed to the pair of discharge rollers 118 by the switching member. The sheet P is then discharged from the copying machine main body 300. This enables the sheet P to be discharged from the copying machine main body 300 in a state that a face thereof having the toner image formed thereon is down (face down).

The discharge of the sheet P in a face down state by such a reverse discharge manner, for example, enables collation of page sequence with respect to image data from a computer when the image forming process is sequentially performed from a leading page. In addition, when the image forming process is performed with respect to a hard sheet P such as an overhead projector (OHP) sheet conveyed from the manual feeding portion 125, the sheet P is discharged from the copying machine main body 300 by the pair of discharge rollers 118 without guidance of the sheet P to the path 122 in a state that a face with a toner image thereon is up (face up).

When the image forming process is performed on both sides of a sheet P, the sheet P is guided to the pair of discharge rollers 118 directly from the fixing portion 117. Immediately after a tail end of the sheet P in the conveying direction passes through the switching member, the sheet P is switched back so as to be guided to a duplex conveying path 124 by the switching member.

The copying machine main body 300 includes a fold processing portion 400 for folding sheets to be discharged therefrom and a finisher 500 attached thereto. The fold processing portion 400 folds the sheets that have already undergone the image forming process, and the finisher 500 performs a binding process or bookbinding process with respect to the sheets. The finisher 500 with a staple portion 500A, a saddle stitch bookbinding portion 800, and a trimmer unit 600 form the sheet processing apparatus of this embodiment. The staple portion 500A, the saddle stitch bookbinding portion 800, and the trimmer unit 600 are described below.

The fold processing portion 400 includes a conveying path 131 for receiving a sheet discharged from the copying machine main body 300 and guiding such a sheet to the side of the finisher 500. A pair of conveying rollers 130 and a pair of discharge rollers 133 are disposed in the conveying path 131. A switching member 135 is disposed in the vicinity of the pair of discharge rollers 133 such that the sheet conveyed by the pair of conveying rollers 130 is guided by the switching member 135 to a folding path 136 or the side of the finisher 500.

When a sheet folding process is performed in the fold processing portion 400, the switching member 135 is first switched, and the sheet is guided to the folding path 136. Subsequently, a leading end of the sheet guided to the folding path 136 in the conveying direction abuts a stopper 137 to form a loop, and the loop is folded as a folding portion by folding rollers 140 and 141.

Next, the folding portion abuts an upper stopper 143 to form a loop and is further folded by the folding roller 141 and another folding roller 142, so that the sheet is folded in a Z-fold. This Z-folded sheet is conveyed to the conveying path 131 through a conveying path 145 and is discharged by the discharge roller pair 133 to the finisher 500 provided on a downstream side in the conveying direction. Since the folding process by the fold processing portion 400 is selectively performed, the switching member 135 is shifted to the side of the finisher 500 so that the sheet discharged from the copying machine main body 300 is directly conveyed into the finisher 500 through the conveying path 131 when the folding process is not performed.

The finisher 500, to which the sheet P having an image thereon is conveyed through the fold processing portion 400, accepts sheets from the copying machine main body 300 to perform a bundle process for aligning a plurality of accepted sheets as one sheet bundle, a sort process, and a non-sort process.

Figure 2:
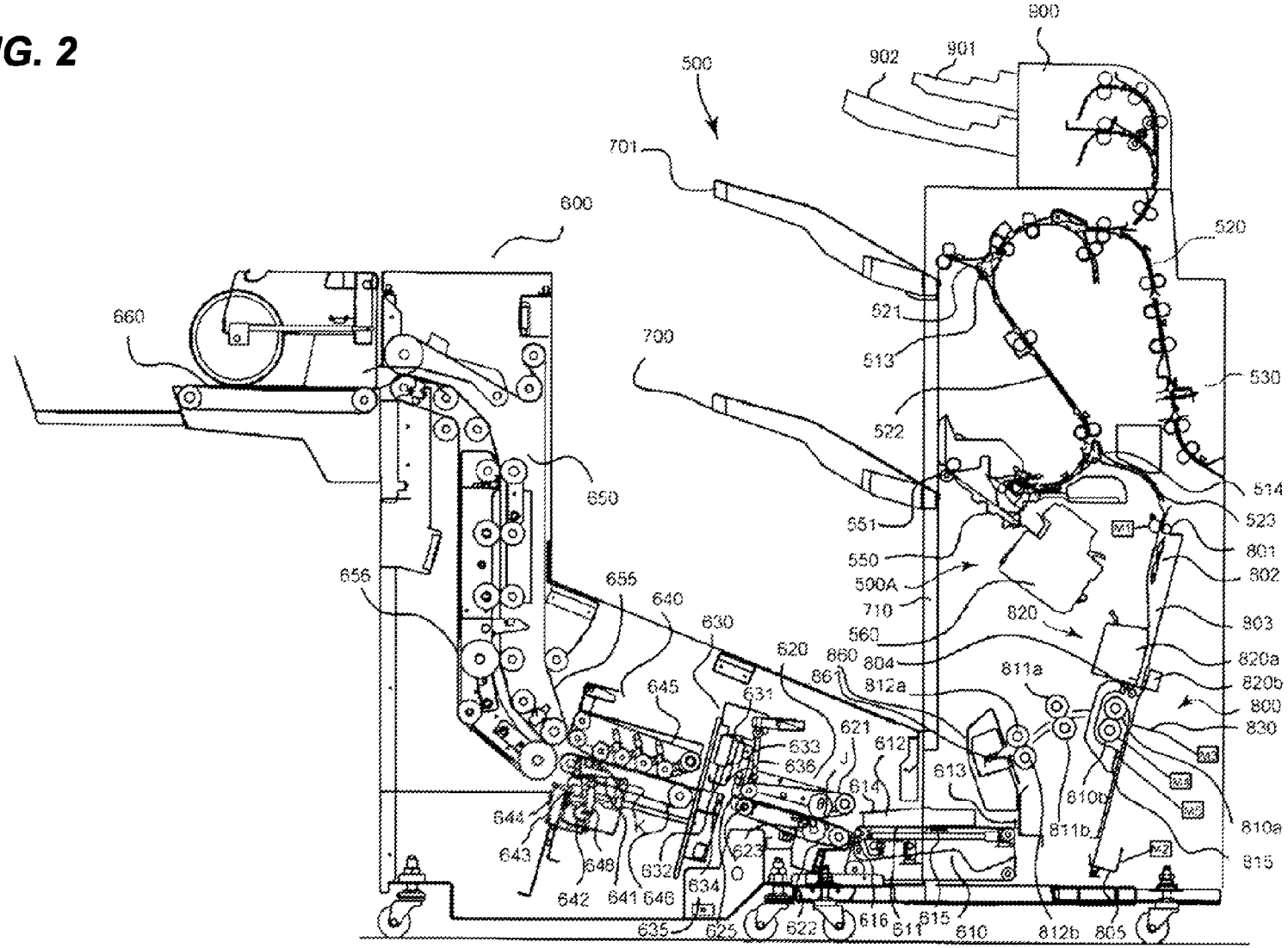
FIG. 2 is a diagram illustrating a structure of a finisher serving as the sheet processing apparatus.

Moreover, the finisher 500 performs processes such as a stapling process (binding process) for stapling a tail end side of a sheet bundle relative to a conveying direction and a bookbinding process. As illustrated in FIG. 2, the finisher 500 includes the staple portion 500A for stapling the sheets and the saddle stitch bookbinding portion 800 for bookbinding the sheet bundle by folding the sheet bundle into two.

The finisher 500 also includes a conveying path 520 for conveying the sheet conveyed through the fold processing portion 400 into the inside of the apparatus. The conveying path 520 is provided with a plurality of conveying roller pairs. A punch unit 530 is disposed partway along the conveying path 520 to perform a punch process for punching a hole in a tail end portion of the conveyed sheet in the conveying direction. The punch unit 530 operates as necessary.

In addition, the conveying path 520 has a terminal end having a switching member 513 provided thereto. The switching member 513 switches between an upper discharge path 521 connected downstream in the conveying direction and a lower discharge path 522. The upper discharge path 521 allows the discharge of the sheet onto an upper stack tray 701, whereas the lower discharge path 522 allows the discharge of the sheet to a process tray 550.

The sheets to be discharged by the lower discharge path 522 to the process tray 550 are held in a bundle while being sequentially aligned so as to undergo a sort process or stapling process in response to a setting of an operation portion 1 illustrated in FIG. 7 (described below). When the stapling process is performed, an optional position on the sheets is stapled by a stapler 560 capable of moving in a sheet width direction.

After the sort process or the stapling process, the sheets are discharged to the upper or lower stack tray 701 or 700 by a pair of bundle discharge rollers 551. Then, a tail end of the sheets discharged on the upper stack tray 701 or the lower stack tray 700 is regulated by a rear end guide 710 that extends in a vertical direction, so that the sheets are aligned.

The upper stack tray 701 and the lower stack tray 700 are movable in a vertical direction. The upper stack tray 701 receives the sheets from the upper discharge path 521 and the process tray 550, whereas the lower stack tray 700 receives the sheets from the process tray 550. The vertical movements of the upper and lower stack trays 701 and 700 enable a large amount of sheets to be loaded thereon.

In FIG. 2, the finisher 500 includes an inserter 900 disposed in an upper portion thereof. The inserter 900 inserts a sheet (insert sheet) that is different from a normal sheet into a first page of the sheet bundle, a last page of the sheet bundle, or between sheets that have images formed thereon by the copying machine main body 300.

When the insert sheet is inserted, the inserter 900 allows the insert sheet set on an inert tray 901 or 902 by a user to be inserted into the conveying path 520 at a desired timing. The insert sheet inserted into the conveying path 520 is then conveyed to any of the upper stack tray 701, the process tray 550, and the saddle stitch bookbinding portion 800.

On the other hand, when the saddle stitch bookbinding is performed with respect to the sheets, the sheets are switched to pass through a saddle discharge path 523 by a switching member 514 disposed partway along the lower discharge path 522 so that the sheets are conveyed to the saddle stitch bookbinding portion 800. Herein, the sheets having passed through the saddle discharge path 523 are first conveyed to a pair of saddle inlet rollers 801, conveyed to a switching member 802 in which a delivery inlet is selected, and then conveyed to a storage guide 803 of the saddle stitch bookbinding portion 800. The switching member 802 is operated by a solenoid according to a sheet size.

Subsequently, the sheets are conveyed by a sliding roller 804 until a leading end thereof in the conveying direction contacts a sheet positioning member 805 which is movable. The saddle inlet roller pair 801 and the sliding roller 804 are driven by a motor M1. A stapler 820 is disposed in a position partway along the storage guide 803, the stapler 820 including a driver 820*a* that ejects a staple (not illustrated) and an anvil 820*b* disposed opposing to the driver 820*a* with the storage guide 803 therebeween to bend the ejected staple.

The sheet positioning member 805 is movable in a vertical direction upon being driven by a motor M2. The sheet positioning member 805 can change a position thereof in response to a sheet size and can be stopped at a position in which a center portion of the sheet in the conveying direction is in a binding position of the stapler 820 during sheet delivery.

On a downstream side in the conveying direction of the stapler 820, a pair of folding rollers 810*a* and 810*b* is disposed, and a protrusion member 830 is disposed in a position opposing to the folding roller pair 810*a* and 810*b*. This protrusion member 830 is positioned retracted from the storage guide 803 as a home position so as to protrude toward the stored sheet bundle by a motor M3.

The protrusion of the protrusion member 830 toward the sheet bundle leads a folding process for folding the sheet bundle by pushing the sheet bundle into a nip between the folding roller pair 810*a* and 810*b*. A pair of aligning plates 815 is also disposed. The pair of aligning plates 815 has a surface protruding toward the storage guide 803 and aligns the sheets stored in the storage guide 803 while moving around an outer circumference of the folding roller pair 810*a* and 810*b*. Upon being driven by a motor M5, the pair of aligning plates 815 moves in a nipping direction relative to the sheets, thereby positioning the sheet in a width direction.

Herein, a pressure F1 sufficient to crease the sheet bundle is being applied between the pair of folding rollers 810*a* and 810*b* by a spring (not illustrated). Upon pushing the sheet bundle into the nip between the pair of folding rollers 810*a* and 810*b*, the protrusion member 830 returns to the home position.

The creased sheet bundle is conveyed to a pair of first fold conveying rollers 811*a* and 811*b*, and a pair of second fold conveying rollers 812*a* and 812*b*. The first fold conveying roller pair 811*a* and 811*b* and the second fold conveying roller pair 812*a* and 812*b* are applied with pressures F2 and F3 that are sufficient to stop and convey the creased sheet bundle. The folding roller pair 810*a* and 810*b*, the first fold conveying roller pair 811*a* and 811*b*, and the second fold conveying roller pair 812*a* and 812*b* are rotated at a constant speed by the same motor M4.

When the sheet bundle bound by the stapler 820 is folded, the sheet positioning member 805 is moved down by a predetermined distance from a position during the stapling process such that a staple position of the sheet bundle is positioned in the nip between the folding roller pair 810 after completion of the stapling process. Therefore, the sheet bundle can be folded with the stapled position as a center, thereby making the folded sheet bundle of a booklet.

Subsequently, the sheet bundle folded by the first fold conveying roller pair 811*a* and 811*b*, and the second fold conveying roller pair 812*a* and 812*b* is conveyed to a crease press unit 860 that includes a pair of press rollers 861 for nipping the crease portion of the sheet bundle. The crease press unit 860 moves in a width direction perpendicular to a conveying direction of the sheet bundle in a state that the crease portion of the sheet bundle is nipped between the press roller pair 861, thereby making a strong crease. Accordingly, a book shaped sheet bundle T is formed.

In this embodiment, the trimmer unit 600 is disposed downstream in the conveying direction of the saddle stitch bookbinding portion 800 as illustrated in FIG. 2, the trimmer unit 600 cutting an open end side of the sheet bundle (booklet) formed by the saddle stitch bookbinding and discharging the sheet bundle. The trimmer unit 600 includes a first conveying portion 610, a second conveying portion 620, a trim portion 630, a third conveying portion 640, a fourth conveying portion 650, and a discharge portion 660 which are sequentially disposed from an upstream side in the conveying direction of the sheet bundle (hereinafter called upstream side). The second, third, and fourth conveying portions 620, 640, and 650 include conveying belt pairs 621 and 622, 645 and 646, and 655 and 656, respectively. Each of upper and lower conveying belts 621 and 622, 645 and 646, and 655 and 656 of the conveying portions 620, 640, 650 is driven by the same motor so as to be driven at the same conveying speed.

The first conveying portion 610 includes a lower conveying belt 611 disposed on a lower side thereof to receive the sheet bundle from the saddle stitch bookbinding portion 800, and side guides 612 disposed on both sides of the lower conveying belt 611. The movement of the side guides 612 in a width direction of the sheet bundle can correct skew feeding of the sheet. The side guides 612 includes a presser guide 614 for preventing opening of the sheet bundle, so that the sheet bundle is smoothly delivered to the second conveying portion 620.

On an upstream side and a downstream side of the presser guide 614, a first conveying portion inlet sensor 615 and a first conveying portion outlet sensor 616 for detecting the presence or absence of the sheet bundle are disposed respectively. Moreover, transport projections 613 are disposed on both sides of the lower conveying belt 611. The transport projections 613 are movable in the sheet bundle conveying direction, and move at a speed that is substantially the same as that of the lower conveying belt 611 to deliver the sheet bundle to the second conveying portion 620. In the case where slippage occurs between the lower conveying belt 611 and the sheet bundle, the transport projections 613 contact a tail end of the sheet bundle to convey the sheet bundle while pushing the tail end thereof.

Figure 3:
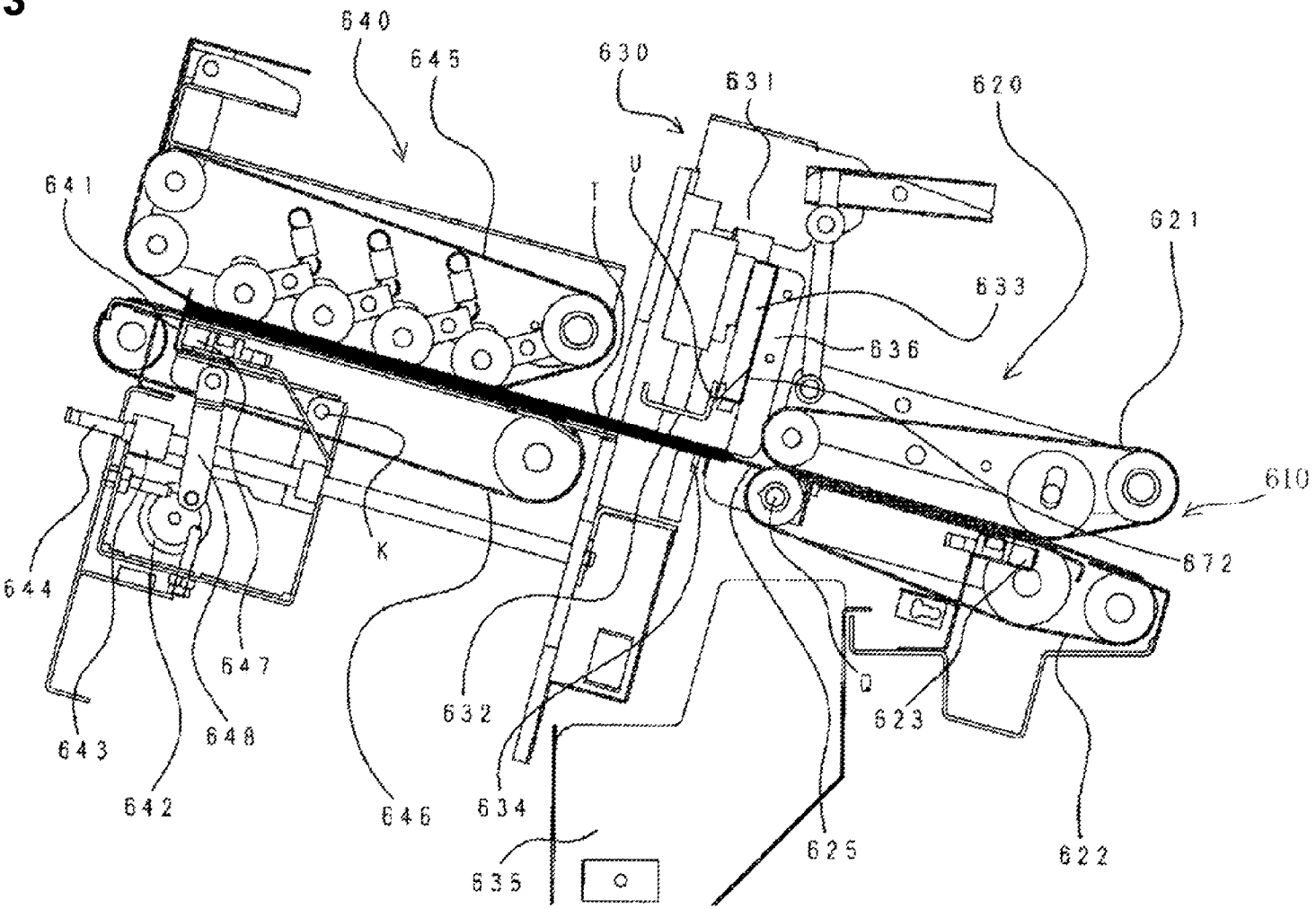
FIG. 3 is a diagram illustrating a structure of a trimmer unit disposed in the finisher.

A second conveying portion inlet sensor 623 is disposed downstream of a nip portion J of the second conveying portion 620 to detect delivery of the sheet bundle to the second conveying portion 620. In the third conveying portion 640, a stopper 641 capable of not only emerging but also moving in the conveying direction is disposed. As illustrated in FIG. 3, the stopper 641 is capable of emerging and retracting around a portion K as a rotation center through cams 642 and 648. The stopper 641 is mounted on a slide block 643, and is driven along a slide guide 644 by a motor (not illustrated) so as to move in response to a size of the sheet bundle in the conveying direction or in response to a stop position of the sheet bundle.

The fourth conveying portion 650 conveys the sheet bundle cut by the trim portion 630 toward up (described below). The discharge portion 660 stacks thereon the sheet bundle conveyed by the fourth conveying portion 650. In this embodiment, the fourth conveying portion 650 extends upward and has an upper end portion including the discharge portion 660 disposed thereto, thereby enhancing removability of the sheet bundle by a user.

As illustrated in FIG. 3, the trim portion 630 includes a cutter unit 631 that is disposed between the second conveying portion 620 and the third conveying portion 640 and is disposed in a direction perpendicular to the conveying path between the second conveying portion 620 and the third conveying portion 630. The cutter unit 631 includes a presser member 632 and an upper blade 633 serving as a movable blade capable of moving up and down. The cutter unit 631 is driven by a cut motor (not illustrated), and moves in a vertical direction with respect to a conveying surface by links 637 (637*a*, 637*b*) illustrated in FIG. 4A.

As illustrated in FIG. 3, the trim portion 630 includes a lower blade 634 serving as a fixed blade fixed to a downstream side (lower portion) in a moving direction of the upper blade 633, and a storage box 635 for storing cutting waste (cutting waste scrap) of the sheets cut with the upper blade 633 and the lower blade 634. The second and third conveying portions 620 and 640 have a conveying portion that conveys the sheets to be cut to an area between the upper blade 633 and the lower blade 634.

When the sheet bundle is cut in the trim portion 630, the cutter unit 631 is moved down. This downward movement of the cutter unit 631 allows the presser member 632 to abut the sheet bundle T before the upper blade 633 abuts the sheet bundle T. Herein, since the presser member 632 is being applied with a force in a downward direction by a spring (not illustrated), the downward movement of the cutter unit 631 allows the presser member 632 to nip the sheet bundle with the conveying surface.

In this state, when the cutter unit 631 further moves down, the upper blade 633 cuts the sheet bundle in conjunction with the lower blade 634.

Figure 4A:
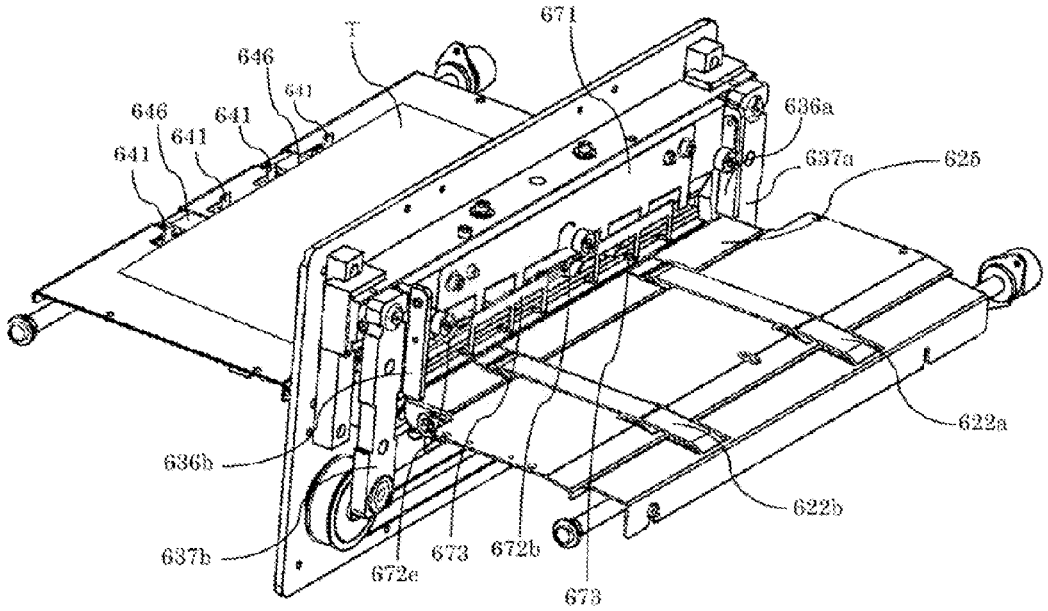
FIGS. 4A and 4B are other diagrams illustrating the structure of the trimmer unit.

On a downstream side of the second conveying portion 620 as illustrated in FIG. 3, a shutter 625 is disposed in an openable and closable manner using a fulcrum Q as a center to open and close a cutting waste dropping path through which the cutting waste is dropped into the storage box 635. In addition, as illustrated in FIG. 4A, cams 636 (636*a*, 636*b*) are disposed in a region other than the conveying path at a lower end of the cutter unit 631. When the cutter unit 631 moves down, the shutter 625 is pressed by the cams 636, thereby opening the dropping path. While the shutter 625 is not being pressed by the cams 636, the shutter 625 is applied with a force by a twist coil spring (not illustrated) to serve as a conveying guide from the conveying belt 622 to the lower blade 634, so that the dropping path of the cutting waste to the storage box 635 is closed. FIG. 4A illustrates a state that the shutter 625 is not being pressed by the cams 636.

Figure 4B:
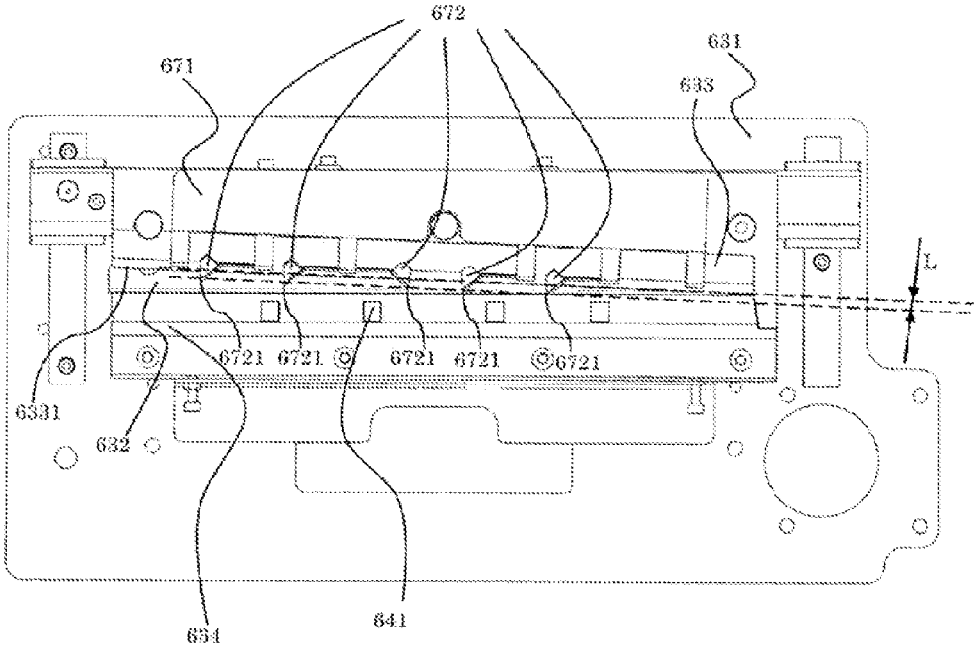
Figure 5:
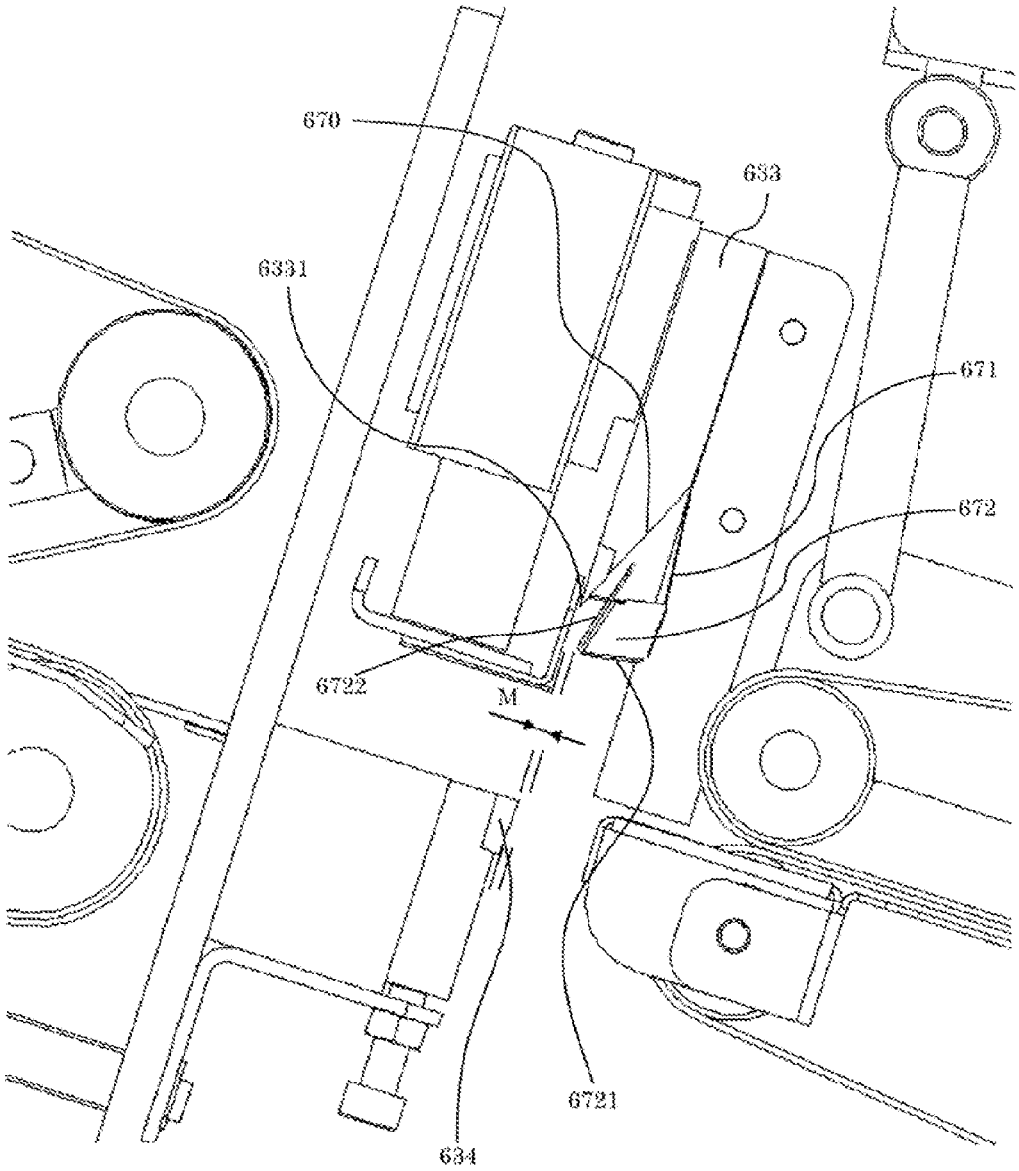
FIG. 5 is a diagram illustrating a structure of a trim portion disposed in the trimmer unit.

FIG. 5 is an enlarged view illustrating the vicinity of the upper blade 633 of the trim portion 630. The upper blade 633 has a side surface 670 inclined with respect to a movement direction of the upper blade 633 which has an edge with an acute angle so as to cut the sheets (sheet bundle). As illustrated in FIG. 4B, the upper blade 633 has a blade edge 6331 linearly provided in an upward manner from the rear toward the front of the apparatus, and the lower blade 634 has a horizontal shape with respect to the conveying path. Accordingly, when moving downward, the upper blade 633 abuts the sheet bundle on the lower blade 634 with a point contact, and then successively cuts the sheet bundle from the rear side toward the front side while moving down along a side surface of the lower blade 634.

As illustrated in FIG. 5, the upper blade 633 has a plate spring 671 fixed thereto, and the plate spring 671 has an assisting sheet 672 serving as an adhesion preventing member attached thereto. The assisting sheet 672 includes a pressing portion 6721 for pressing down cutting waste to one end. The assisting sheet 672 is formed of an elastic member and is attached such that the pressing portion 6721 is positioned lower than the blade edge 6331 of the upper blade 633 by a predetermined amount L as illustrated in FIG. 4B.

Figure 9:
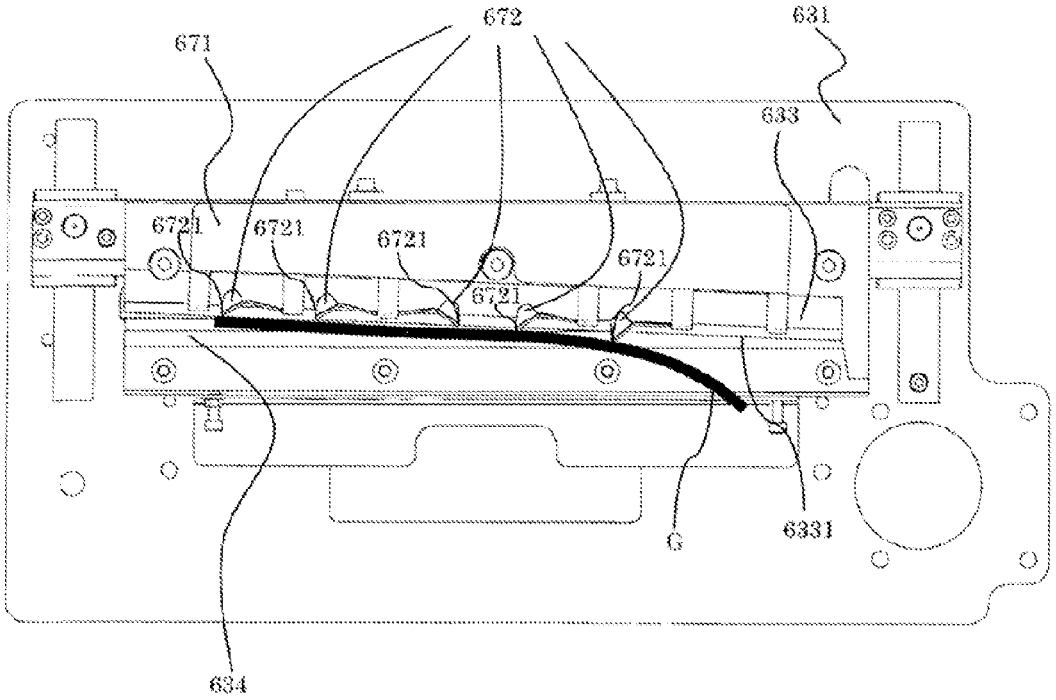
FIG. 9 is a diagram illustrating the operation of the trimmer unit.

Such an arrangement of the assisting sheet 672 can allow the pressing portion 6721 of the assisting sheet 672 to abut the sheet bundle T before the upper blade 633 contacts the sheet bundle T when the sheets are cut. Moreover, the downward movement with the upper blade 633 allows the assisting sheet 672 to press the sheet bundle T and to apply a force to the sheet bundle T while being elastically distorted upward. When the sheet bundle is cut, therefore, the upper blade 633 cuts the sheet bundle in a state the assisting sheet 672 applies the force to the sheets while being distorted. Once the sheet bundle T is cut in a state of being applied with the force by the assisting sheet 672, the assisting sheet 672 elastically moves down while releasing the distortion thereof, so that the cutting waste of the sheet bundle T is pressed down by the pressing portion 6721 of the assisting sheet 672 to a position below the blade edge of the upper blade 633 as illustrated in FIG. 9 (described below).

Moreover, as illustrated in FIG. 4B, a plurality of assisting sheets 672 is disposed at intervals from one another along a leading end of the upper blade 633. Specifically, the plural assisting sheets 672 are disposed in a longitudinal direction of the upper blade 633 (herein, 5 locations). This arrangement enables the cutting waste of the sheet bundle to be pressed at a plurality of points, thereby reducing the likelihood of adhesion of the cutting waste to an end portion of the lower blade 634 compared to a case where the cutting waste is pressed at a single point. Herein, the assisting sheets 672 are provided in positions corresponding to various sizes of sheet bundles T to be conveyed to the trim portion 630. Accordingly, cutting waste generated from any size of the sheet bundle T can be reliably pressed down.

The predetermined amount L relating to the attachment position of the assisting sheet 672 varies with a thickness or material of the assisting sheet 672. Based on experiences, however, when the assisting sheet 672 is made of PET sheet with a thickness of 0.5 mm and is attached with a predetermined amount L of approximately 5 mm, the cutting waste can be suitably dropped. If a predetermined amount L is greater than necessary, the sheet bundle is buckled before being cut and a sheet bundle cannot be pressed.

As illustrated in FIG. 5, the assisting sheet 672 has an opposing surface 6722 disposed opposite the side surface 670 of the upper blade 633. The assisting sheet 672 is disposed such that there is space between the side surface 670 and the opposing surface 6722.

Herein, a width of the space is preferably small such that the assisting sheet 672 can suitably drop down the cutting waste even if a cutting width of the cutting waste is short. There may be cases where the cutting waste is sandwiched in the space between the side surface 670 and the opposing surface 6722. In such cases, however, the cutting waste can be dropped by vibration of the assisting sheet 672 as described below.

In addition, the assisting sheet 672 is provided opposing to a side surface of the lower blade 634 such that a predetermined space M is formed therebetween. Such formation of the predetermined space M can reduce the possibility of cutting the assisting sheet 672 caused by moving the assisting sheet 672 on the lower blade 634 when the upper blade 633 moves down to cut the sheets. The smaller the predetermined space M is, the easier the thin waste can be pressed. However, when the predetermined space M is excessively small, the space between the side surface 670 and the opposing surface 6722 is also small, causing the cutting waste to be sandwiched therebetween. Consequently, the predetermined space M can be set approximately 1.5 mm based on experiences, so that the cutting waste can be suitably dropped down. Such values of the predetermined amount L and the predetermined space M are examples, and not limited thereto.

Figure 6A:
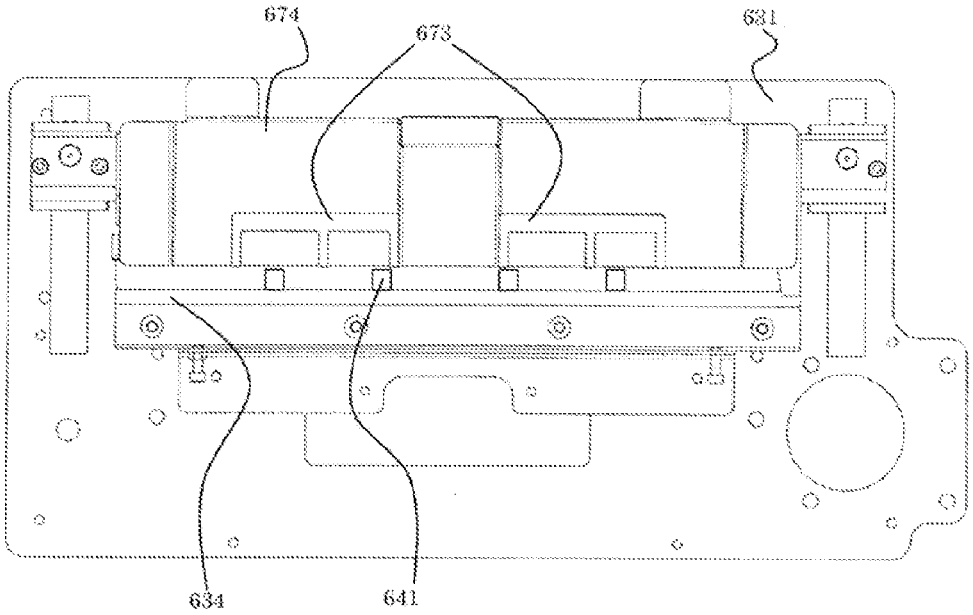
FIGS. 6A and 6B are other diagrams illustrating the structure of the trim portion.
Figure 6B:
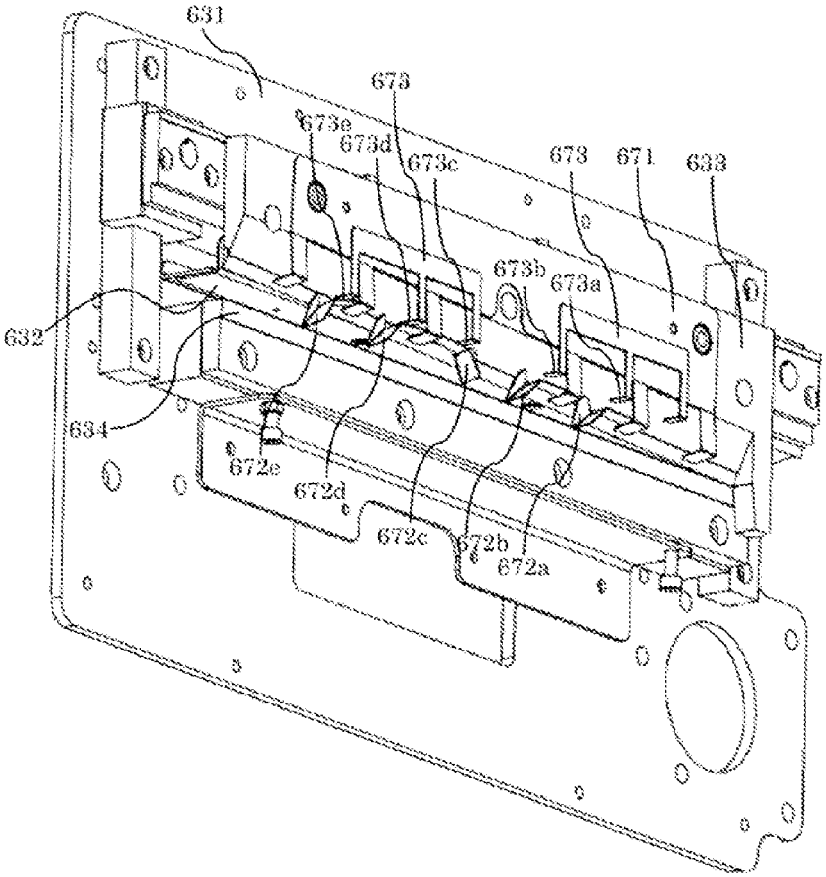

As illustrated in FIG. 6A, the cutter unit 631 has an upper blade cover 674 attached thereon, and the upper blade cover 674 has a vibrating sheet 673, serves as a vibrating member, attached thereon. The vibrating sheet 673 is formed of an elastic member and has abutting surfaces 673*a* through 673*e* each of which is perpendicularly bent as illustrated in FIG. 6B. As described below, when the upper blade 633 makes an upward movement, these abutting surfaces 673*a* through 673*e* abut and distort respective assisting sheets 672*a* through 672*e*. When the assisting sheets 672*a* through 672*e* are distorted by a predetermined amount, the abutting surfaces 673*a* through 673*e* are released so as to vibrate the assisting sheets 672*a* through 672*e*. FIGS. 4A, 4B, and 6B illustrate an example structure in which the upper blade cover 674 illustrated in FIG. 6A is removed for sake of simplicity.

Figure 7:
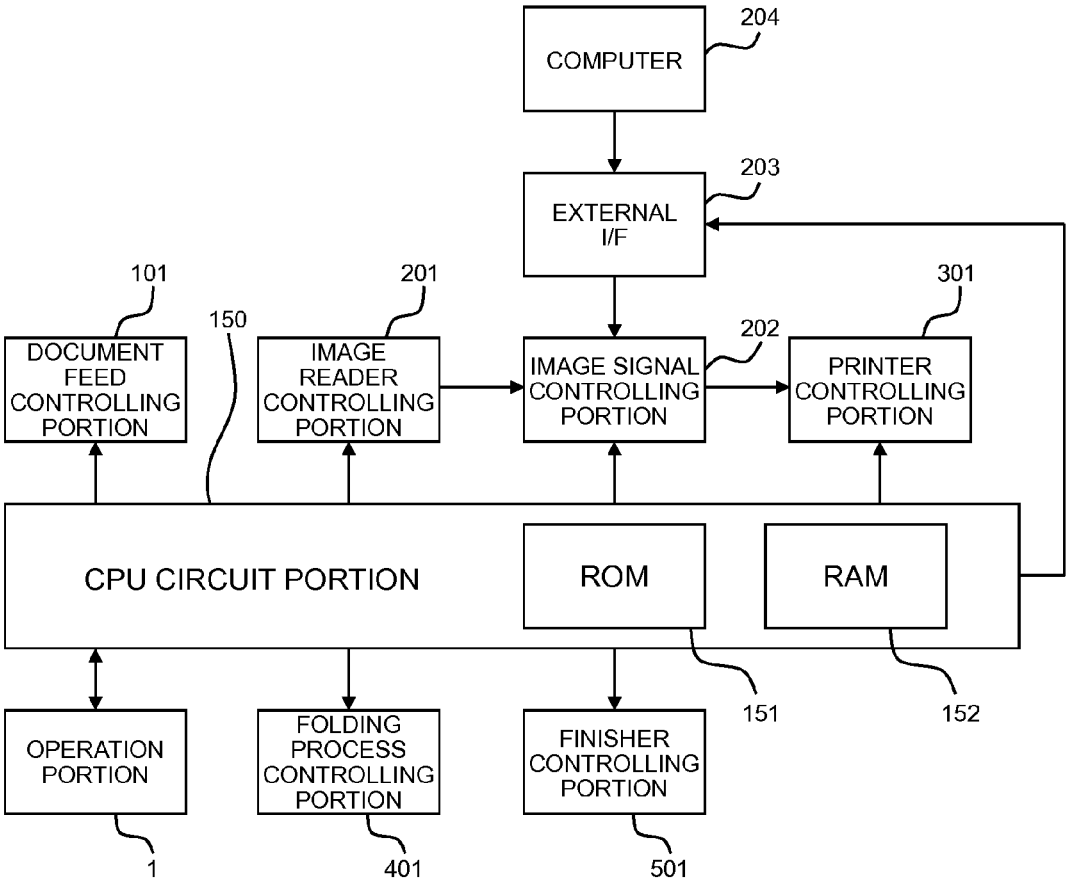
FIG. 7 is a control block diagram illustrating the copying machine.

FIG. 7 illustrates a control block diagram of the copying machine 1000. A central processing unit (CPU) circuit portion 150 includes a CPU (not illustrated). The CPU circuit portion 150 controls a document feed controlling portion 101, an image reader controlling portion 201, an image signal controlling portion 202, a printer controlling portion 301, a folding process controlling portion 401, a finisher controlling portion 501, and an external interface (I/F) 203 according to a control program stored in a read only memory (ROM) 151 and a setting of the operation portion 1. The document feed controlling portion 101, the image reader controlling portion 201, the printer controlling portion 301, and the folding process controlling portion 401 control the document feeding portion 100, the scanner 200, the image forming portion 1003, and the fold processing portion 400, respectively. The finisher controlling portion 501 controls the finisher 500, the trimmer unit 600, the saddle stitch bookbinding portion 800, and the inserter 900.

The operation portion 1 includes a plurality of keys to be used for setting a various functions relating to image forming, and a display portion for displaying a setting state thereon. The operation portion 1 outputs a key signal corresponding to each of the keys operated by a user to the CPU circuit portion 150, and allows information based on the signal from the CPU circuit portion 150 to be displayed on the display portion.

A random access memory (RAM) 152 serves as a region to temporarily hold control data or as a workspace for computation associated with controlling. The external I/F 203 serves an interface between the copying machine 1000 and an external computer 204. The external I/F 203 expands print data from the computer 204 to a bitmap image and outputs such an image as image data to the image signal controlling portion 202. Moreover, an image of the document read by the image sensor 109 is output from the image reader controlling portion 201 to the image signal controlling portion 202. The printer controlling portion 301 allows the image signal controlling portion 202 to output the image data to the exposure controlling portion 110.

Figure 8:
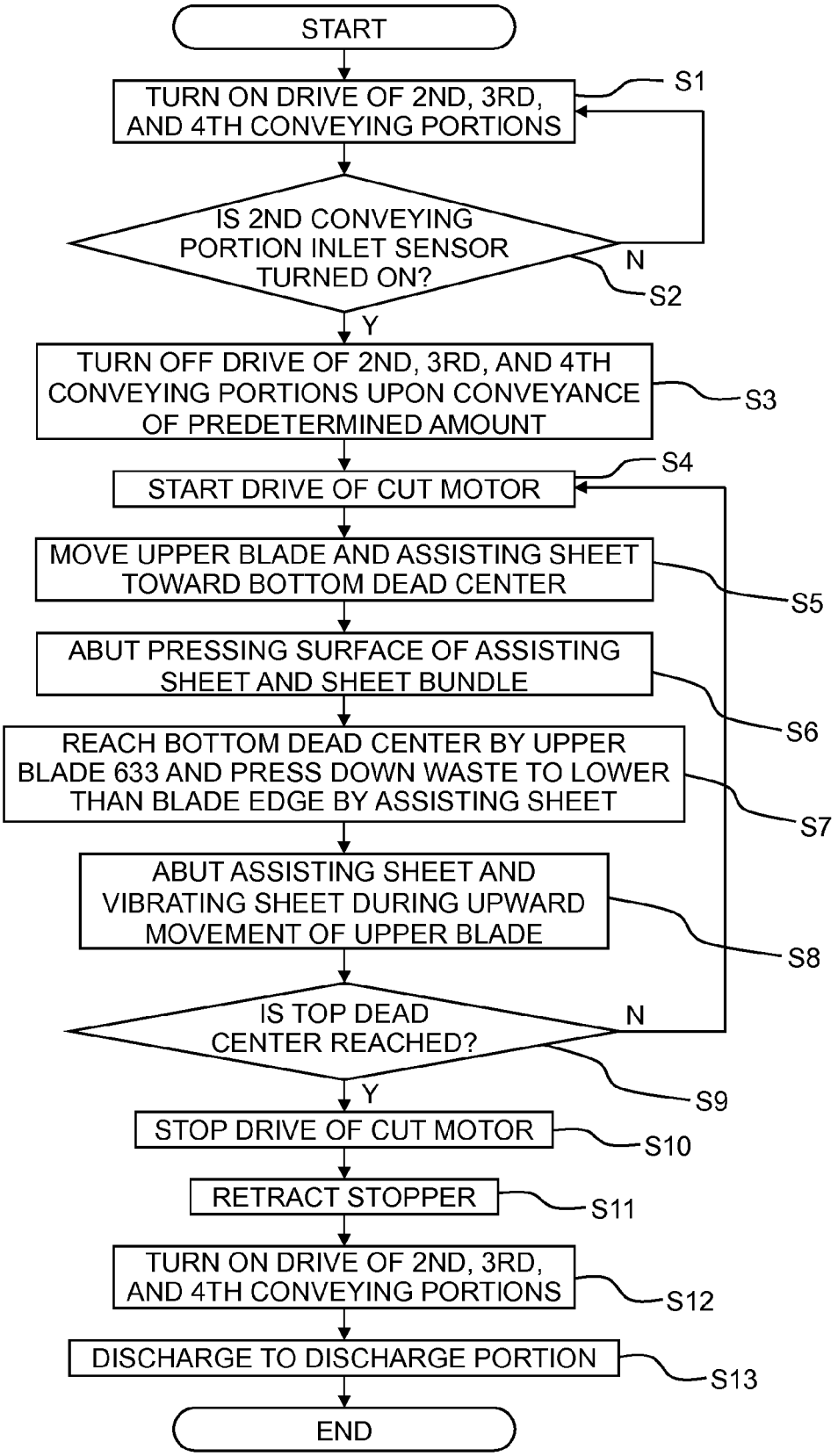
FIG. 8 is a flowchart illustrating operation of the trimmer unit.

Next, the operation of the trimmer unit 600 of this embodiment is described with reference to a flowchart of FIG. 8. When the strong crease is made on the sheet bundle by the crease press unit 860 as described above, the conveyance of the sheet bundle is resumed to deliver the sheet bundle to the first conveying portion 610 of the trimmer unit 600. Subsequently, the lower conveying belt 611 of the first conveying portion 610 is rotated to convey the sheet bundle. When the first conveying portion outlet sensor 616 detects the sheet bundle, the conveyance of the sheet bundle once stops. Then, the side guides 612 disposed on both sides of the conveying path align the sheet bundle, and the conveyance of the sheet bundle is resumed by the lower conveying belt 611 and the transport projections 613 disposed upstream of the first conveying portion 610.

Next, the drive of the second, third, and fourth conveying portions 620, 640, and 650 is turned on (S1), and the second conveying portion 620 receives the sheet bundle from the first conveying portion 610. When the second conveying portion inlet sensor 623 disposed in the nip portion J between the second conveying belt pair 621 and 622 detects the sheet bundle and is turned on (Y in S2), the transport projections 613 are retracted upstream in the conveying direction. Then, the sheet bundle passes the second conveying portion 620 and the trim portion 630, and is conveyed to the third conveying portion 640.

In the third conveying portion 640 at this time, the stopper 641 has emerged in an appropriate position on the conveying path in advance according to a size of the sheet bundle T as described above with reference to FIGS. 3 and 4A. This allows the sheet bundle T to abut the stopper 641 in a place where the sheet bundle T is conveyed a predetermined distance from the second conveying portion inlet sensor 623. After the sheet bundle T abuts the stopper 641, the drive of the second, third, and fourth conveying portions 620, 640, and 650 is turned off (S3) and the conveyance of the sheet bundle T stops.

Subsequently, the drive of the cut motor for the cutter unit 631 of the trim portion 630 is started (S4). The drive of the cut motor allows the cutter unit 631 to move down and the upper blade 633 and the assisting sheet 672 to move toward a bottom dead center (S5). In such movements, the pressing portion 6721 of the assisting sheet 672 abuts the sheet bundle (S6), and then a tail end portion of the sheet bundle T is cut from the rear side according to an edge shape of the upper blade 633 in a state that the assisting sheet 672 is applying a force to the sheet bundle T.

When the upper blade 633 is moved down with the downward movement of the cutter unit 631, the pressing portion 6721 of the assisting sheet 672 serving as an elastic member is distorted by contacting a cutting waste G as illustrated in FIG. 9. This displaces the assisting sheet 672 to a position above an initial position. Then, when the upper blade 633 reaches the bottom dead center and cuts the tail end portion of the sheet bundle T, the assisting sheet 672 is promptly released from the distortion and moves down, thereby pressing down the cutting waste G to a position below the blade edge 6331 of the upper blade 633 (S7). Accordingly, even when the sheets are charged, the cutting waste scrap (cutting waste) G can be dropped down without adhering to the upper blade 633 and the lower blade 634.

Figure 10A:
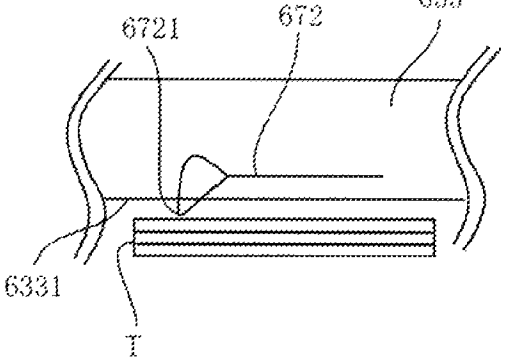
FIGS. 10A, 10B, and 10C are diagrams illustrating an assisting sheet disposed to a cutter unit of the trim portion.
Figure 10B:
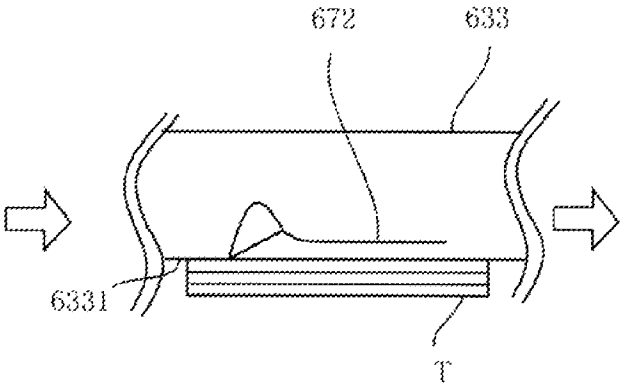
Figure 10C:
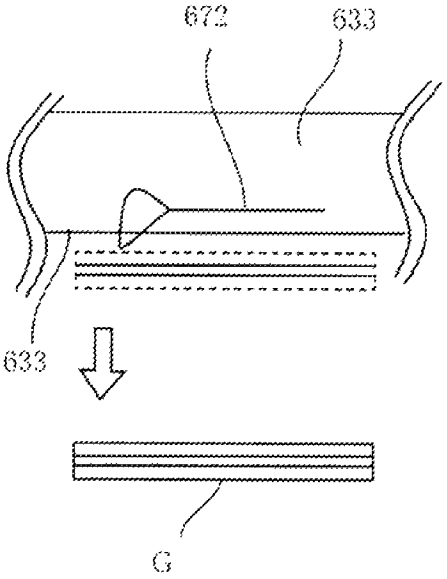

FIGS. 10A, 10B, and 10C illustrate the operation of the assisting sheet 672 in such a situation. When the upper blade 633 moves down, the pressing portion 6721 of the assisting sheet 672 contacts the sheet bundle T as illustrated in FIG. 10A. When the upper blade 633 further moves down, the assisting sheet 672 is further pressed against the sheet bundle T and elastically deforms upward as illustrated in FIG. 10B. Subsequently, when the upper blade 633 reaches the bottom dead center and cuts the tail end portion of the sheet bundle T, the distortion of the assisting sheet 672 is released promptly by an elastic restoring force as illustrated in FIG. 10C. Accordingly, the assisting sheet 672 moves down while pressing the cutting waste G, and the pressing portion 6721 is moved to a position below the blade edge 6331 of the upper blade 633. Consequently, the cutting waste G is pressed down to a position below the blade edge 6331 of the upper blade 633.

Then, the upper blade 633 moves up. This upward movement of the upper blade 633 allows the abutting surfaces 673*a* through 673*e* of the vibrating sheets 673 attached to the upper blade cover 674 to abut the respective assisting sheets 672*a* through 672*e* as illustrated in FIG. 6B (S8).

Figures 11A, 11B, 11C, 11D:
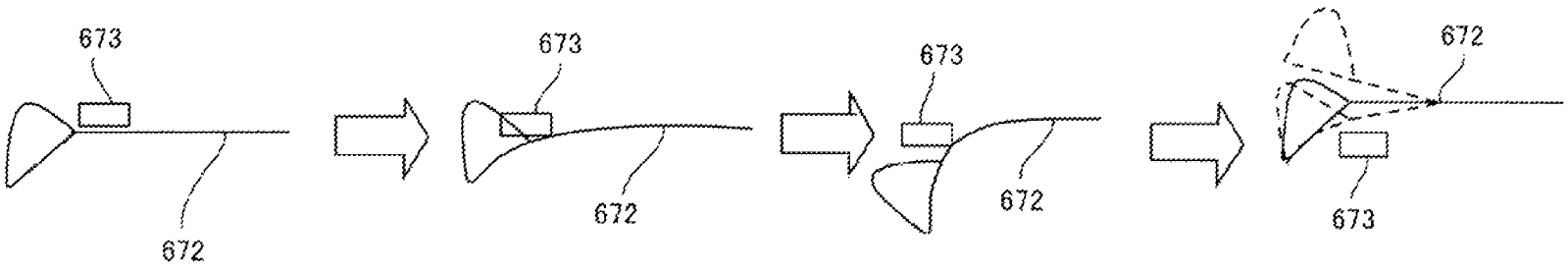
FIGS. 11A, 11B, 11C, and 11D are diagrams illustrating operation of the assisting sheet and a vibrating sheet.

FIGS. 11A through 11D illustrate a state that the vibrating sheets 673 and the assisting sheets 672 in such a situation. That is, when the upper blade 633 moves up as illustrated in FIGS. 11A and 11B, the vibrating sheet 673 serving as a vibrating member and the assisting sheet 672 abut each other. When the upper blade 633 further moves up, the distortion is generated to both of the vibrating sheet 673 and the assisting sheet 672. When these sheets 673 and 672 are distorted by a predetermined amount, the abutment is released as illustrated in FIG. 11D, and the assisting sheet 672 vibrates.

Figure 12A:
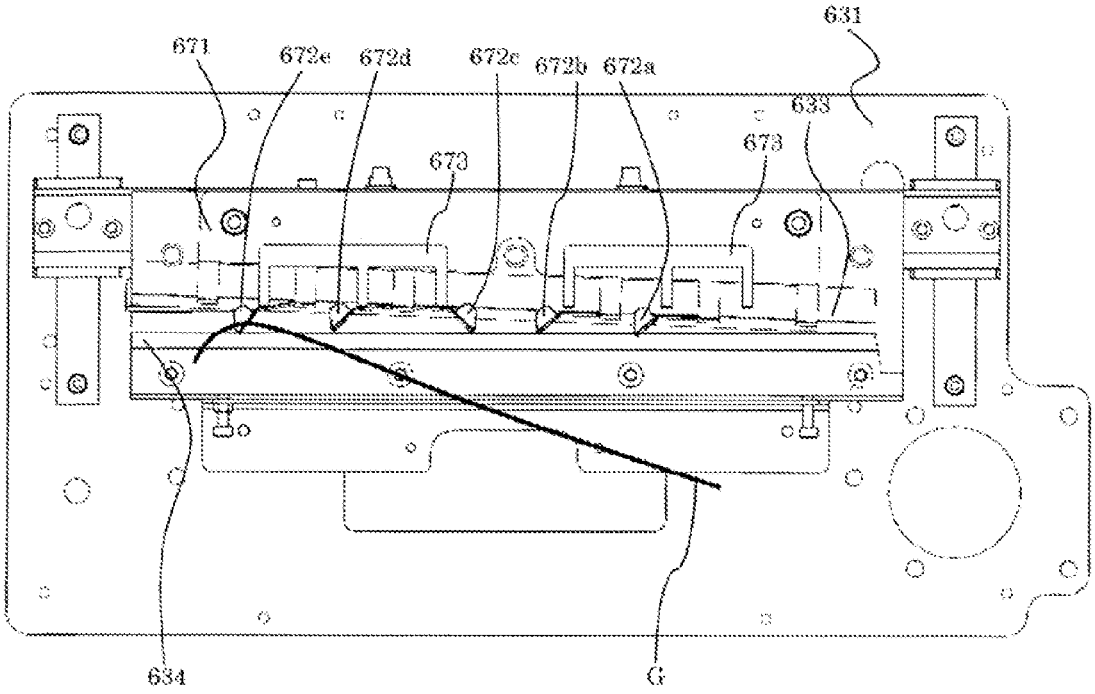
FIGS. 12A and 12B are other diagrams illustrating the operation of the trimmer unit.
Figure 12B:
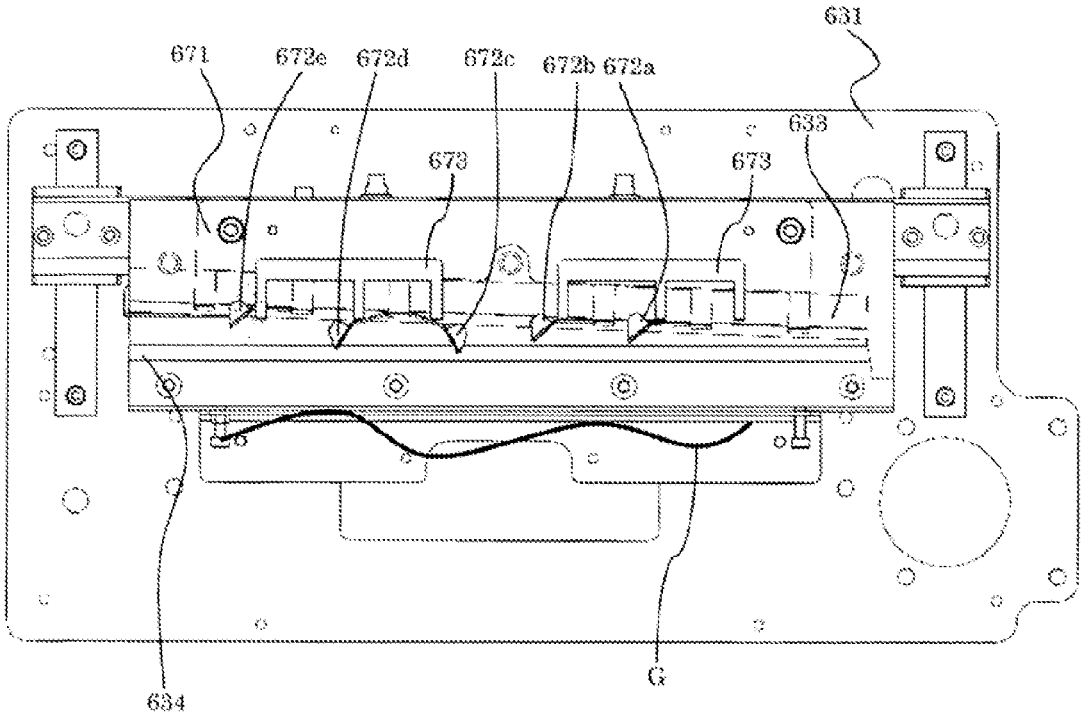

When the cutting waste G is pressed down by the assisting sheet 672 as described above, there are cases where the cutting waste G is sandwiched between the side surface 670 of the upper blade 633 and the opposing surface 6722 of the assisting sheet 672 illustrated in FIG. 5 instead of being pressed down by the assisting sheet 672. For example, as illustrated in FIG. 12A, there are cases where the cutting waste G is sandwiched between the assisting sheet 672*e* and the side surface 670 of the upper blade 633. In such cases, however, the vibration of the assisting sheets 672*e* through 672*a* in a sequential manner can drop down the cutting waste G sandwiched between the side surface 670 of the upper blade 633 and the assisting sheet 672*e* as illustrated in FIG. 12B.

When the cutter unit 631 moves down, the shutter 625 is pressed by the cams 636 to rotate downward so as to open the dropping path of the cutting waste G before a sheet bundle is cut. Herein, the dropping path is opened from the cutting portion including the upper blade 633 and the lower blade 634 to a storage box 635. Thus, the cutting waste G can be reliably stored in the storage box 635 without remaining in the conveying path.

Figure 13:
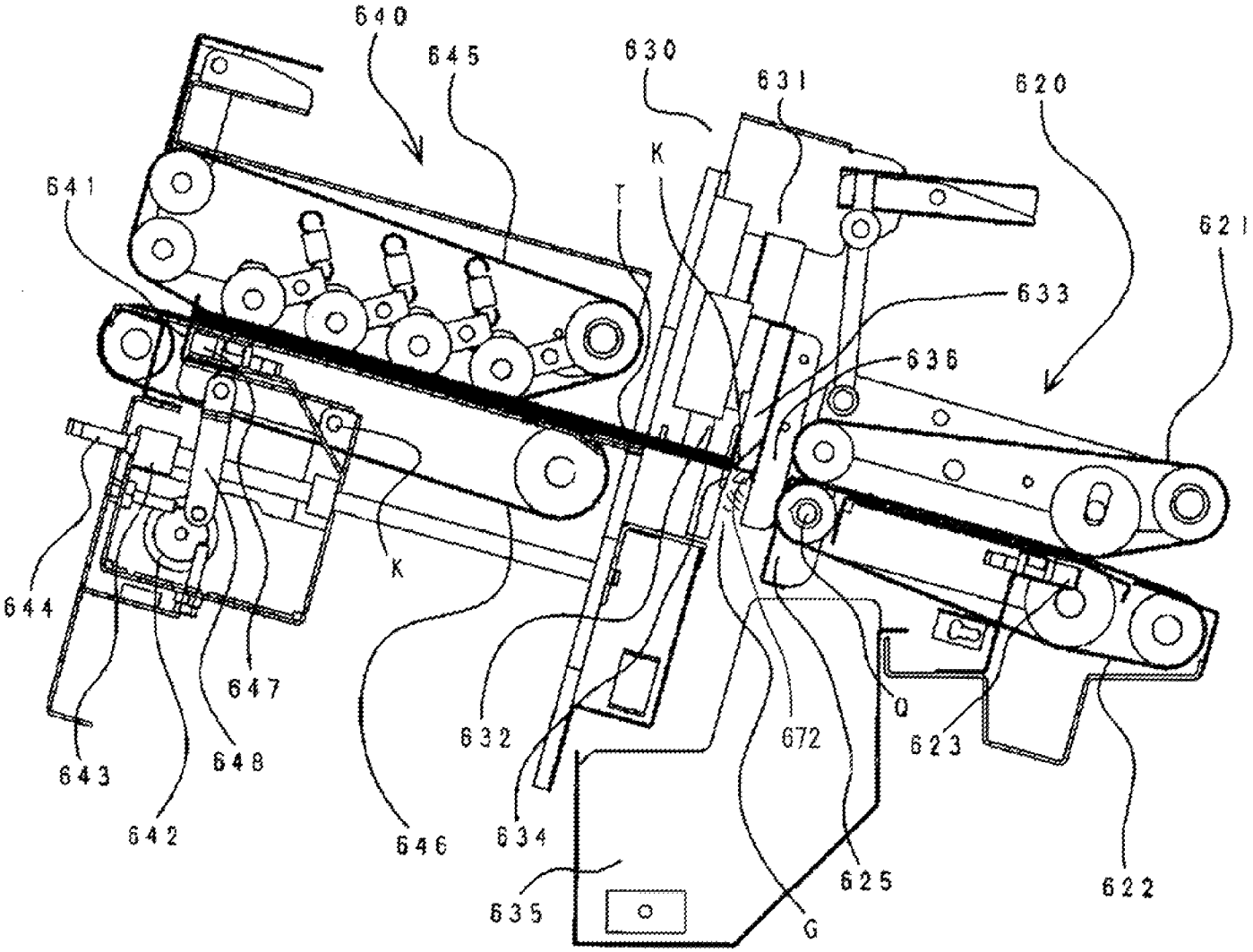
FIG. 13 is a diagram illustrating a state that the cutter unit has reached a bottom dead center.

Next, the cutter unit 631 once stops upon reaching a bottom dead center K in the vicinity of the lowest point in the movable region of the link 637 illustrated in FIG. 13. Then, when the cutter unit 631 returns to the initial position illustrated in FIG. 3 (top dead center U in the vicinity of highest point in the movable region of the link 637) (Y in S9), the drive of the cut motor stops (S10).

A stopping-time of the cutter unit 631 in the bottom dead center K is set so as to be longer than a bundling time required for the smallest number of sheets in a sheet bundle to be prepared by the saddle stitch bookbinding portion 800. The stop of the cutter unit 631 in the bottom dead center K can ensure the open time of the cutting waste dropping path opened by the shutter 625, so that the cutting waste G is reliably dropped into the storage box 635 as described above.

Since the cams 636 are separated from the shutter 625 when the cutter unit 631 returns to the initial position (top dead center U), the shutter 625 closes the cutting waste dropping path using a twist coil spring. Subsequently, the stopper 641 is retracted (S11), and the drive of each of the second, third, and fourth conveying portions 620, 640, and 650 is turned on to resume the sheet conveyance (S12). The sheet bundle undergoes the cutting process in the trim portion 630 and is conveyed by the third conveying portion 640 to the fourth conveying portion 650 disposed downstream of the third conveying portion 640.

The sheet bundle is further conveyed upward by the fourth conveying portion 650 and is discharged to the discharge portion 660 (S13). The sheet bundles are sequentially discharged and stacked in an imbricated manner on the discharge portion 660. When the sheet bundles are successively conveyed, the similar operation is repeated and the desired number of the sheet bundles is stacked on the discharge portion 660.

According to this embodiment, therefore, the downward movement of the assisting sheet 672 with the upper blade 633 elastically presses down the cutting waste G of the sheet, thereby dropping the cutting waste G into the storage box 635 from the conveying path. Moreover, when the cutting waste G is sandwiched between the opposing surface 6722 of the assisting sheet 672 and the side surface 670 of the upper blade 633, the assisting sheet 672 is vibrated, so that the cutting waste G is reliably dropped into the storage box 635.

According to this embodiment, therefore, when a sheet bundle is cut by downward movement of the upper blade 633, the assisting sheet 672 is moved down to a position below the blade edge of the upper blade 633, thereby reducing occurrences of adhesion of the cutting waste to the lower blade 634. Accordingly, the cutting waste G does not remain in a conveying path. This can reduce quality deterioration caused by the cutting waste which is stacked and held with a sheet bundle and reduce malfunction of a sensor disposed within the conveying path, thereby providing reliable operation. Moreover, since the assisting sheet 672 integrally moves with the upper blade 633, an additional drive mechanism is not necessarily disposed and thus a simple structure can be achieved.

Figure 14:
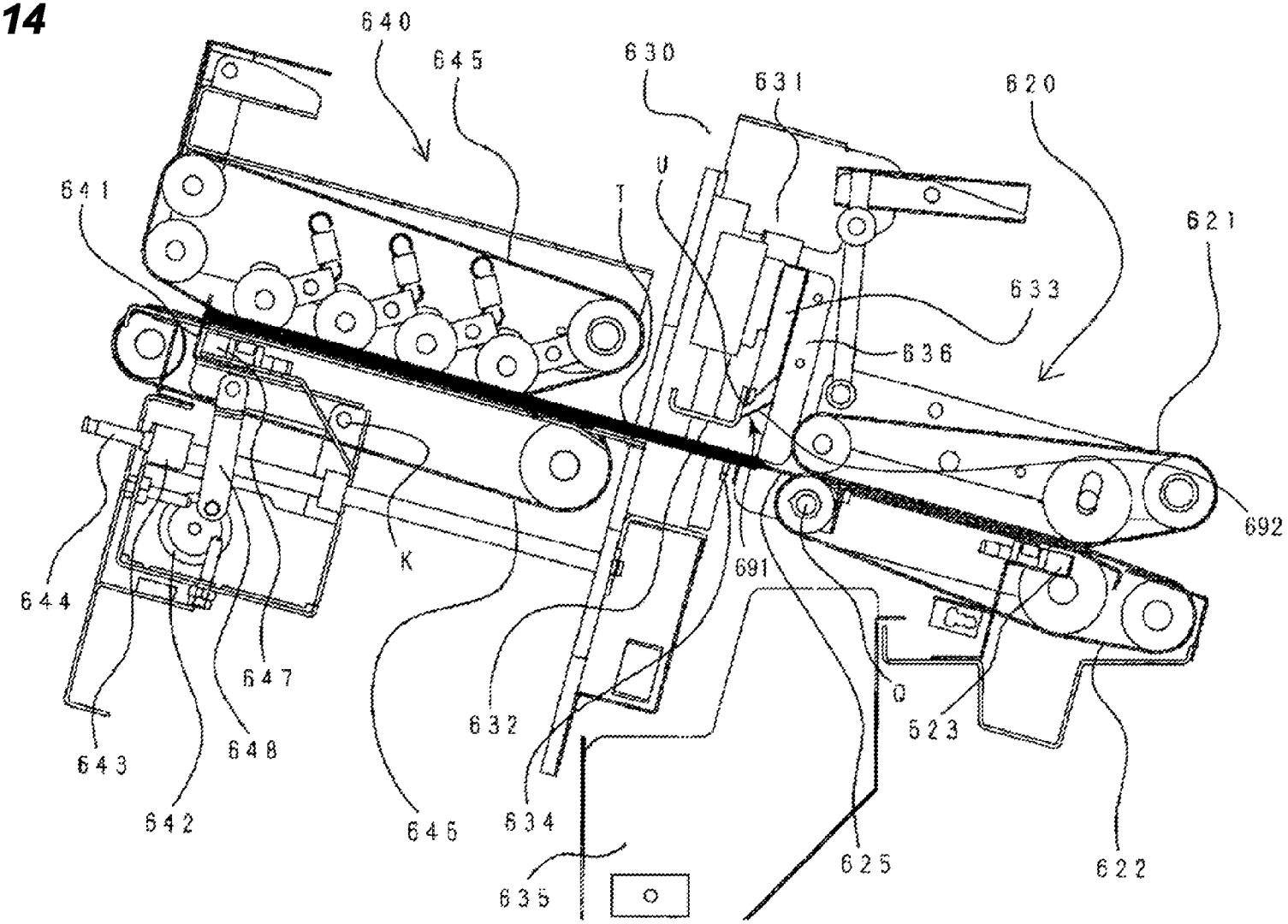
FIG. 14 is a diagram illustrating a trimmer unit of a finisher serving as a sheet processing apparatus according to a second embodiment of the present invention.

Next, a second embodiment of the present invention is described. FIG. 14 illustrates a structure of a trimmer unit 600 of a finisher serving as a sheet processing apparatus according to the second embodiment. As the trimmer unit 600 of FIG. 14 is similar to that of FIG. 3, like reference numbers used in FIG. 14 and FIG. 3 designate corresponding parts.

Figure 15:
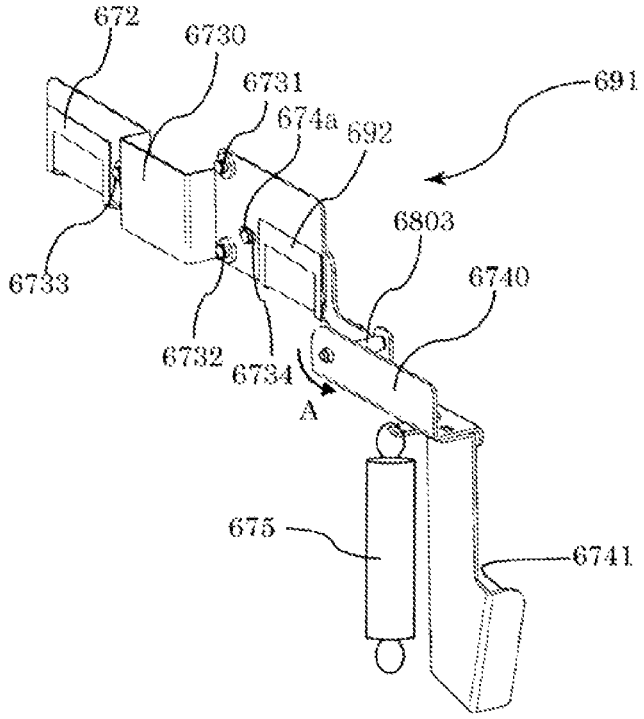
FIG. 15 is a diagram illustrating a structure of a scraping unit of a cutter unit disposed in a trim portion of the trimmer unit.

In FIG. 14, a scraping unit 691 is disposed in a cutter unit 631 to scrape cutting waste from an upper blade 633 and a lower blade 634. The scraping unit 691 includes a scraping sheet 692 for scraping the cutting waste, a slide plate 6730 having the scraping sheet 692 attached thereto, and an arm 6740 coupled to the slide plate 6730 as illustrated in FIG. 15. The arm 6740 is applied with a downward force by a spring 675.

Figure 16A:
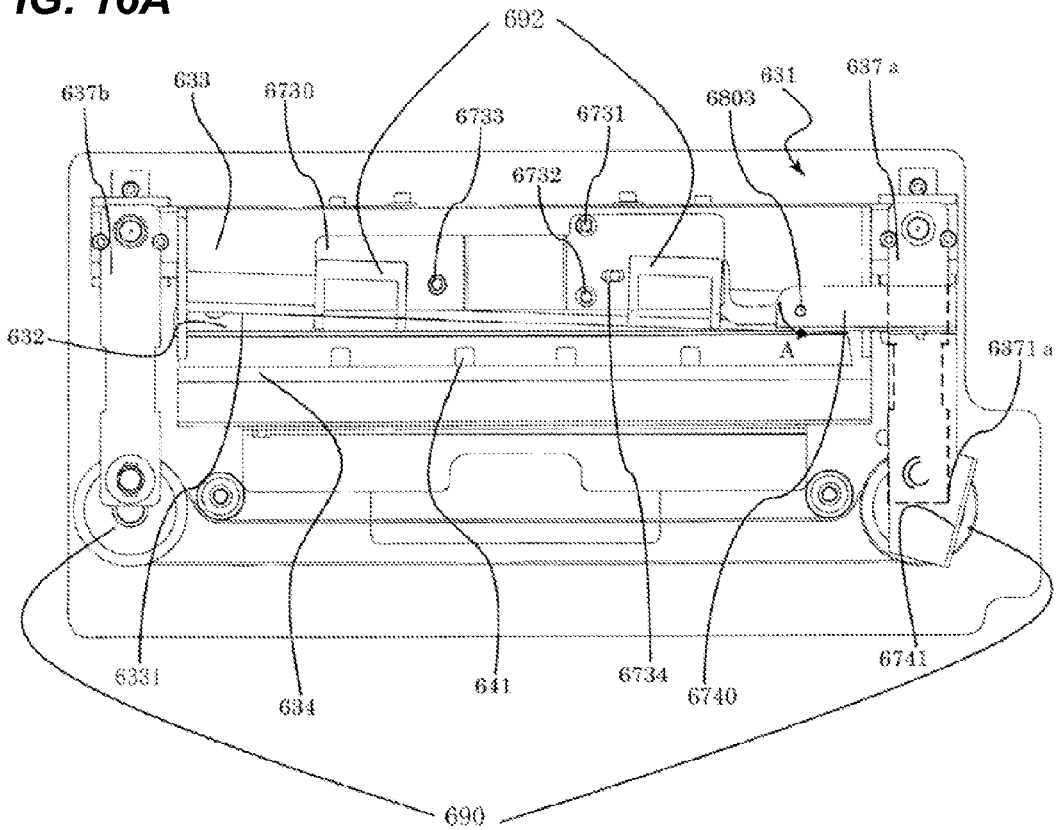
FIGS. 16A and 16B are diagrams illustrating the cutter unit.

The slide plate 6730 having the scraping sheet 692 as an adhesion preventing member attached thereto includes slide shafts 6731 through 6733 for scraping operation as illustrated in FIGS. 15 and 16A. The slide shafts 6731 through 6733 slide in a vertical direction by moving along long circular holes 6801 and 6802 formed on an upper blade cover 680 illustrated in FIG. 16B.

The slide plate 6730 also has a long circular hole 6734 as illustrated in FIG. 15. The slide plate 6730 and the arm 6740 are coupled by insertion of a shaft 674*a* disposed in one end of the arm 6740 into the long circular hole 6734. The arm 6740 rotates around a shaft 6803 attached to the upper blade cover 680, and includes an abutting surface 6741 for abutting a link 637*a* so as to rotate.

The link 637*a* has an end portion 6371*a* that abuts the abutting surface 6741 of the arm 6740 by rotation of rotation cams 690 of FIG. 16A. The link 637*a*, the arm 6740 and the rotation cams 690 constitute an interlock portion which moves up and down the scraping sheet 692 interlocking with an up and down movement of the upper blade 633. The arm 6740 pressed by the end portion 6371*a* of the link 637*a* rotates around the shaft 6803 in a direction indicated by an arrow A. Such rotation is transmitted to the slide plate 6730, thereby moving down the slide plate 6730.

Figure 16B:
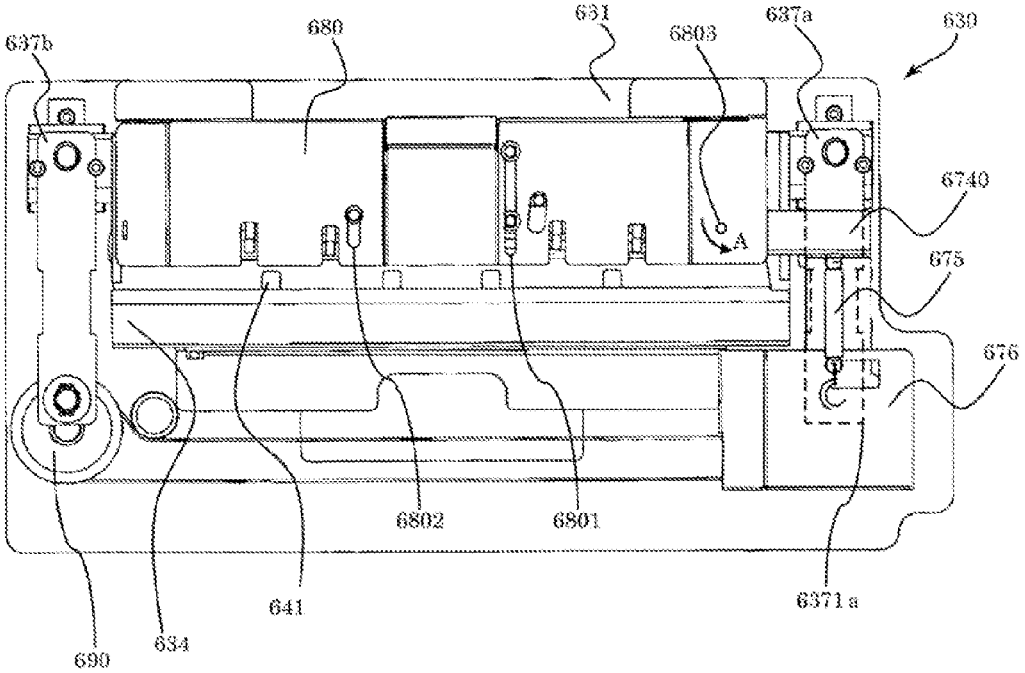

As illustrated in FIG. 16B, the spring 675 has one end attached to the arm 6740 and another end attached to the cover 676 attached on the cutter unit 631. Accordingly, the arm 6740 is always applied with a force in a direction opposite to the arrow A, and the slide plate 6730 coupling to the arm 6740 of FIG. 16A and the scraping sheet 692 are also applied with upward forces.

Figure 17A:
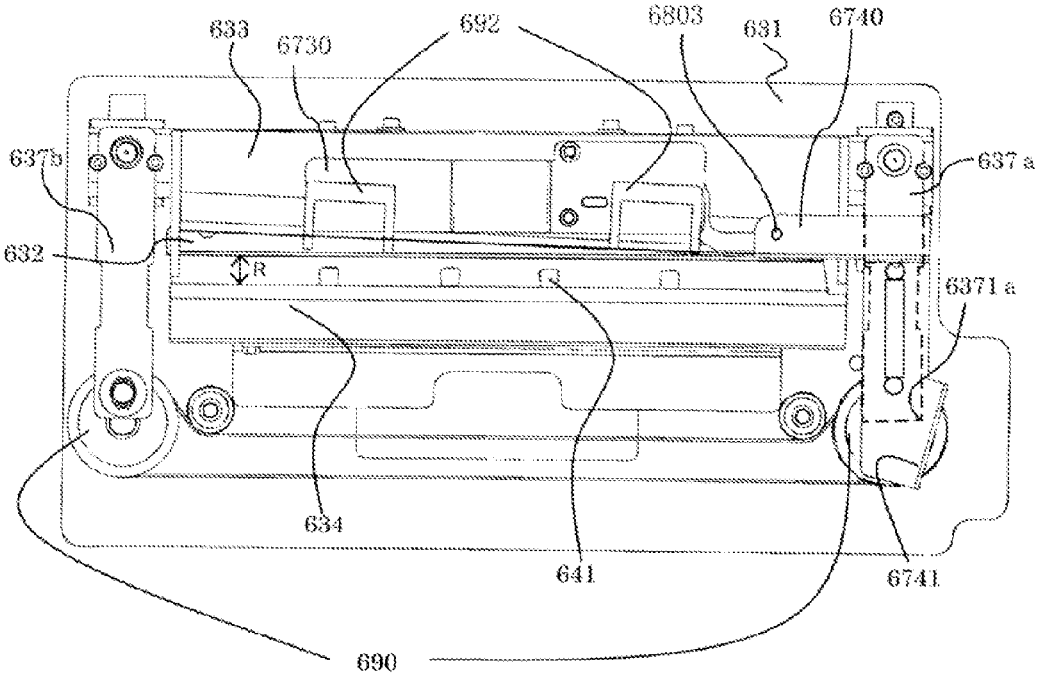
FIGS. 17A and 17B are diagrams illustrating operation of the cutter unit.

FIGS. 17A, 17B, 18A, and 18B illustrate the operation of the cutter unit 631 disposed in the trim portion 630. FIG. 17A illustrates an initial state that the upper blade 633 is positioned in a top dead center (retracted) with respect to the lower blade 634. Herein, a presser member 632 that moves with the upper blade 633 is also positioned in the top dead center, and the lower blade 634 and the presser member 632 form therebetween a space R through which a sheet bundle passes. Since the scraping sheet 692 is positioned above the space R, the passage of the sheet bundle is not disturbed.

Figure 17B:
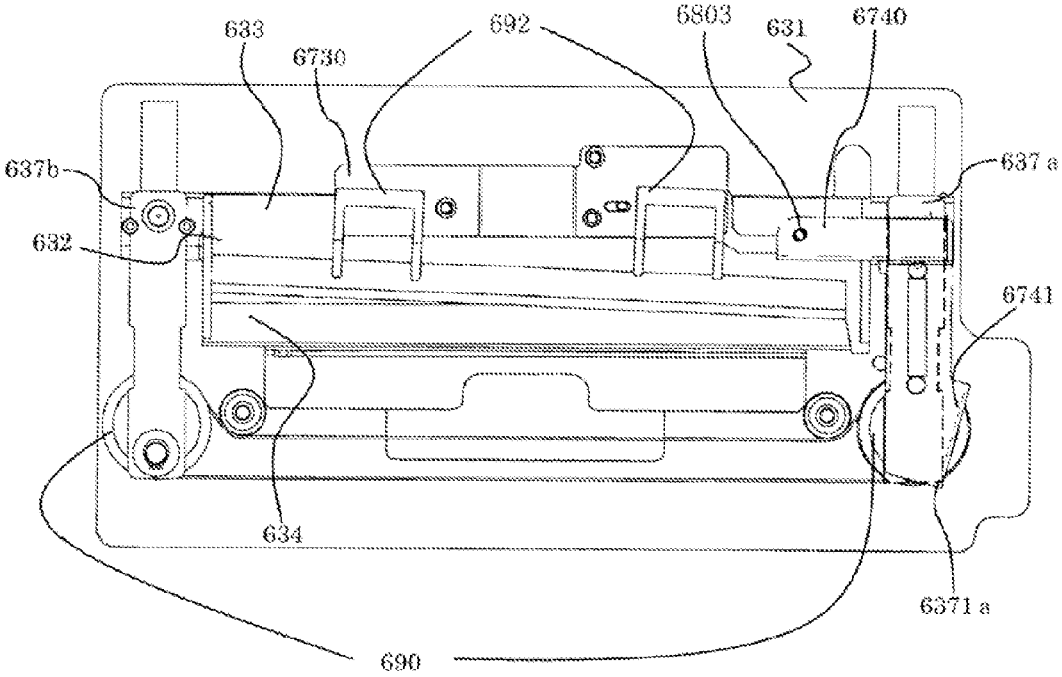
Figure 18A:
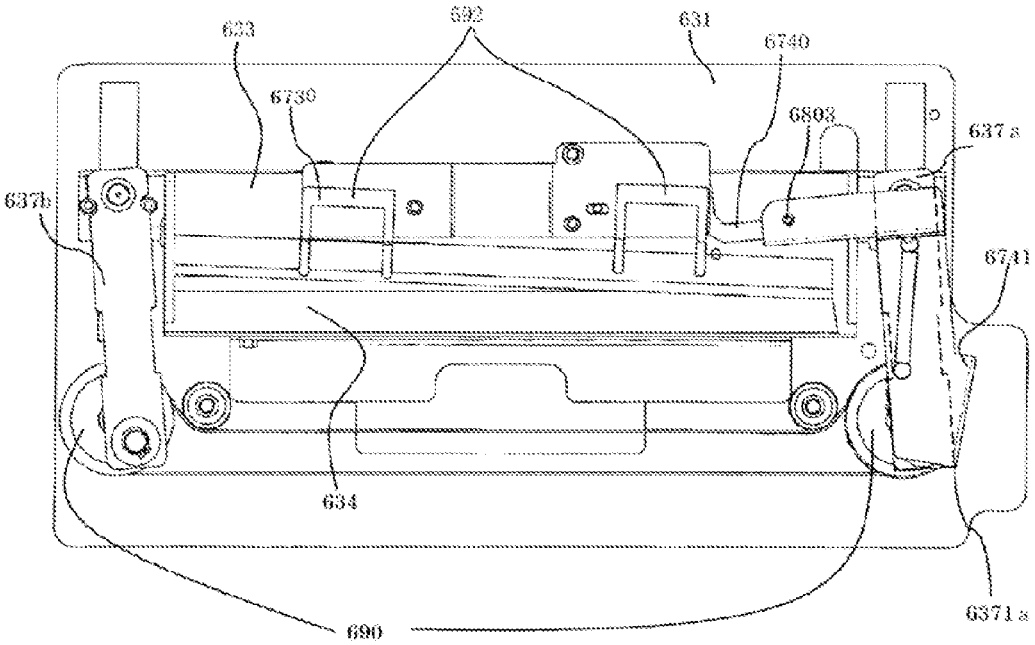
FIGS. 18A and 18B are other diagrams illustrating the operation of the cutter unit.

When the rotation cams 690 rotate 180 degrees in a counter-clockwise direction from the initial position of FIG. 17A, the upper blade 633 reaches the bottom dead center through the links 637*a* and 637*b* illustrated in FIG. 17B. Thus, the sheet bundle is cut. When the rotation cams 690 further rotate, the link 637*a* and the abutting surface 6741 of the arm 6740 abut each other, so that the arm 6740 is rotated counter-clockwisely around the shaft 6803. Then, the slide plate 6730 and the scraping sheet 692 start to move down as illustrated in FIG. 18A.

Figure 18B:
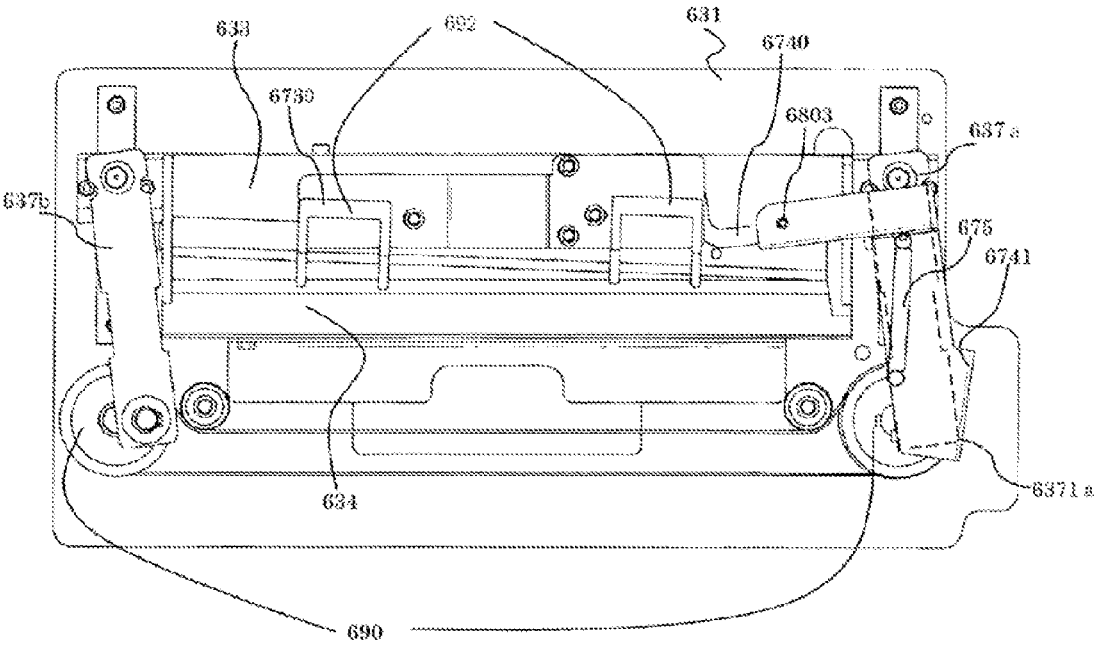

When the cams 690 rotate approximately 270 degrees, the scraping sheet 692 reaches the bottom dead center with the upper blade 633 overlapped as illustrated in FIG. 18B, that is, the scraping sheet 692 reaches a bottom dead center which contacts a side surface of the lower blade 634 in a state that the upper blade 633 is positioned lateral to the lower blade 634. Therefore, the scraping sheet 692 scrapes the cutting waste from the upper blade 633 and lower blade 634 before reaching the bottom dead center. Then, the further rotation of the rotation cams 690 rotates the arm 6740 in a clockwise direction around the shaft 6803 with the force applied by the spring 675.

Accordingly, the slide plate 6730 and the scraping sheet 692 return to the initial positions. The upper blade 633 reaches the top dead center serving as the initial position illustrated in FIG. 17A by rotation of the rotation cams 690.

Figure 19:
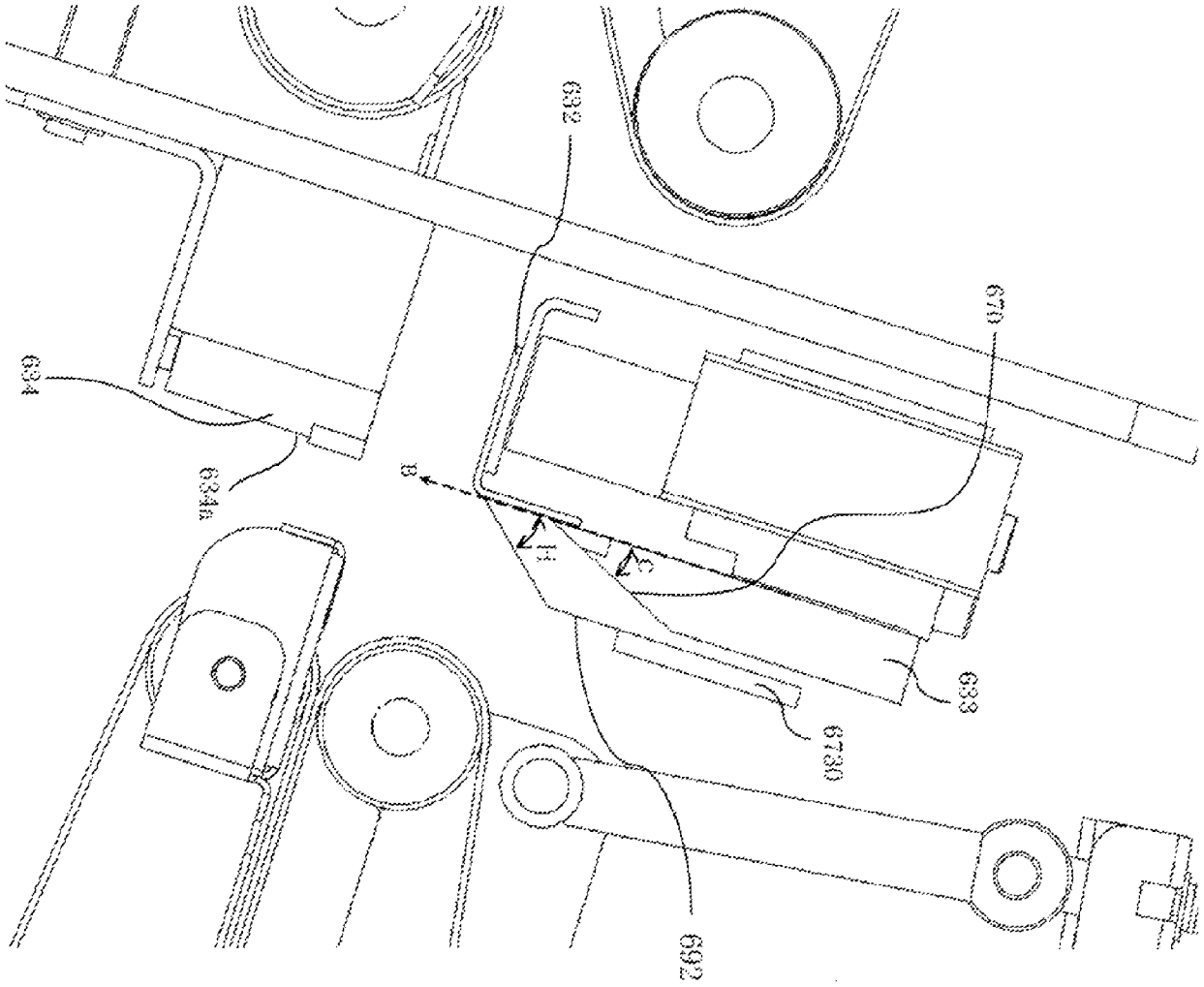
FIG. 19 is a diagram illustrating a structure of the scraping unit.

The scraping sheet 692 is attached so as to have an angle H that is greater and more acute than an angle (inclination angle) C formed by a cutting direction B and a side surface 670 of the upper blade 633 as illustrated in FIG. 19. Such a scraping sheet 692 acutely abuts the side surface 670 of the upper blade 633 and the cutting waste adhered to the side surface 634*a* of the lower blade 634 when moving down. Therefore, the cutting waste can be surely scraped without slipping through the scraping sheet 692.

Figure 20:
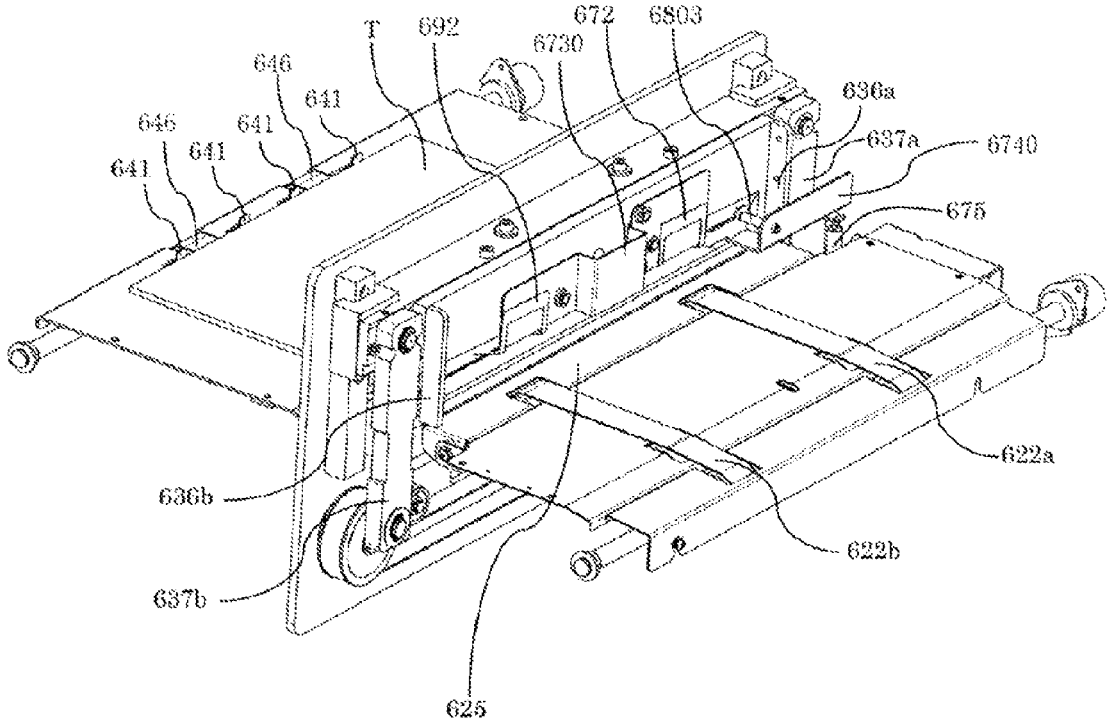
FIG. 20 is another diagram illustrating the structure of the scraping unit.

Moreover, a plurality of scraping sheets 692 is disposed at intervals from one another along a leading end of the upper blade 633 in a longitudinal direction of the upper blade 633 as illustrated in FIGS. 16A and 20. Specifically, the plural scraping sheets 692 are disposed in the longitudinal direction of the upper blade 633 (herein, 2 scraping sheets). This enables the cutting waste of the sheets to be scraped at a plurality of points, thereby reducing the likelihood of adhesion of the cutting waste to an end portion of the lower blade 634 compared to a case where the cutting waste is scraped at a single point. Herein, the scraping sheets 692 are provided in positions corresponding to various sizes of sheet bundles T to be conveyed to the trim portion 630, so that cutting waste generated from any size of the sheet bundle can be reliably scraped.

Figure 21:
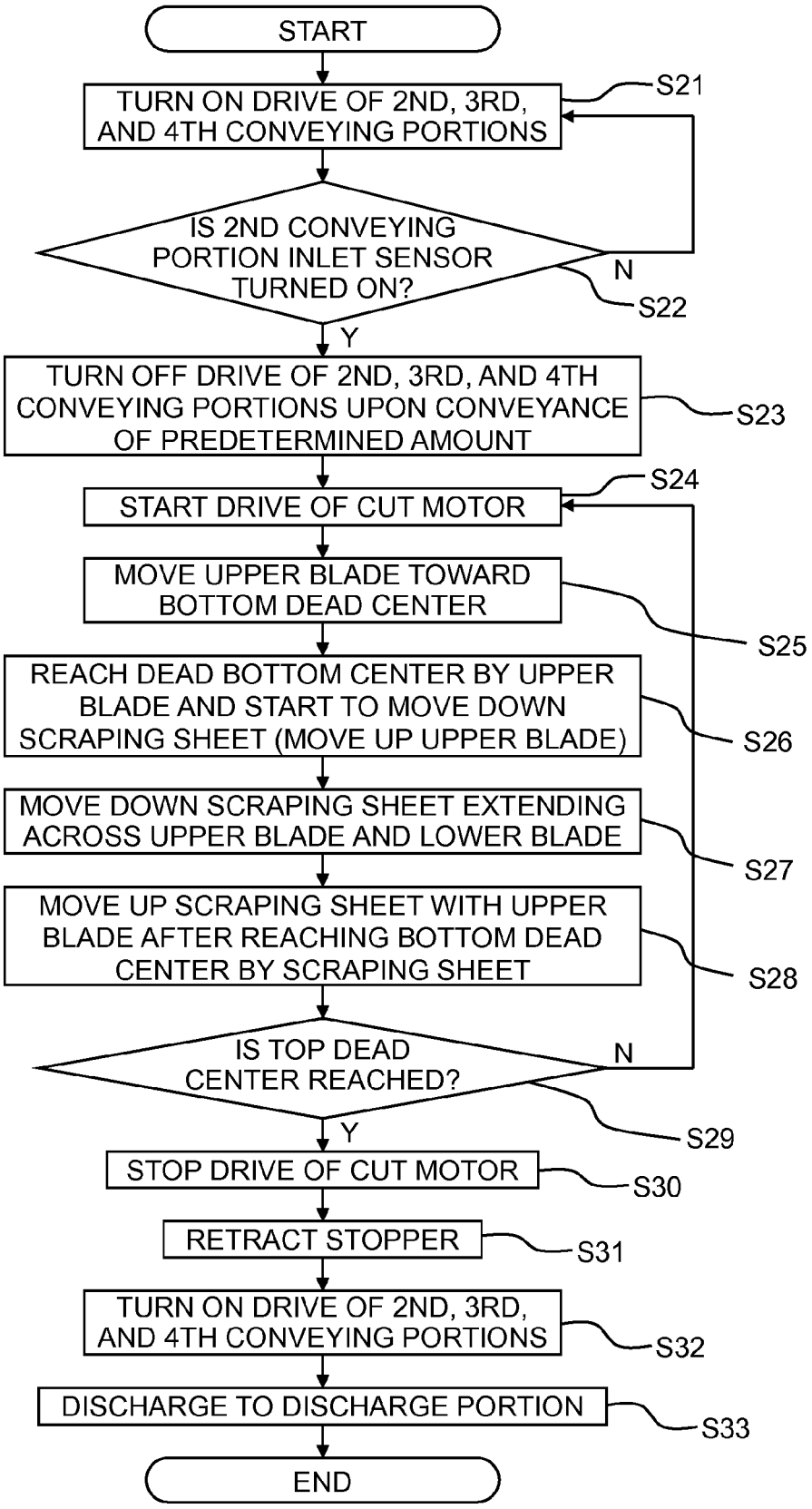
FIG. 21 is a flowchart illustrating the operation of the trimmer unit.

Now, the operation of the trimmer unit 600 according to the second embodiment is described with reference to a flowchart of FIG. 21. When the strong crease is made on the sheet bundle by the crease press unit 860 as described above, the conveyance of the sheet bundle is resumed to deliver the sheet bundle to a first conveying portion 610 of the trimmer unit 600. Then, a lower conveying belt 611 of the first conveying portion 610 is rotated to convey the sheet bundle. When a first conveying portion outlet sensor 616 detects the sheet bundle, the conveyance of the sheet bundle once stops. Subsequently, side guides 612 disposed on both sides of the conveying path align the sheet bundle, and the conveyance of the sheet bundle is resumed by the lower conveying belt 611 and transport projections 613 disposed upstream of the first conveying portion 610.

Next, the drive of second, third, and fourth conveying portions 620, 640, and 650 is turned on (S21), and the second conveying portion 620 receives the sheet bundle from the first conveying portion 610. When a second conveying portion inlet sensor 623 disposed in a nip portion J between a second conveying belt pair 621 and 622 detects the sheet bundle and is turned on (Y in S22), the transport projections 613 are retracted upstream in the conveying direction. Then, the sheet bundle passes through the second conveying portion 620 and the trim portion 630, and is conveyed to the third conveying portion 640.

In the third conveying portion 640 at this time, a stopper 641 has emerged in an appropriate position on the conveying path in advance according to the size of the sheet bundle T as illustrated in FIG. 20. This allows the sheet bundle T to abut the stopper 641 in a place where the sheet bundle T is conveyed a predetermined distance from the second conveying portion inlet sensor 623. After the sheet bundle T abuts the stopper 641, the drive of the second, third, and fourth conveying portions 620, 640, and 650 is turned off (S23) and the conveyance of the sheet bundle T stops.

Figure 22A:
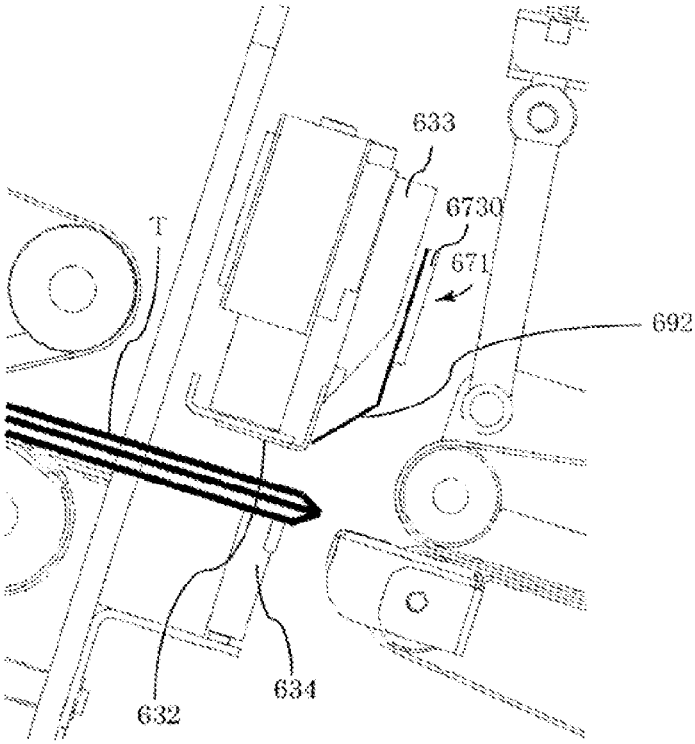
FIGS. 22A and 22B are diagrams illustrating the operation of the trimmer unit.
Figure 22B:
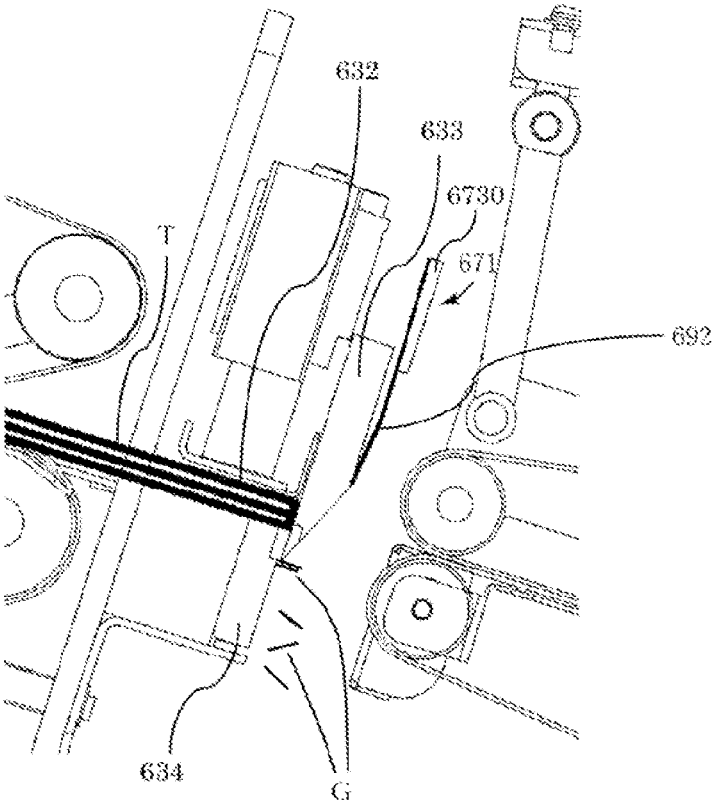

Subsequently, the drive of the cut motor for the cutter unit 631 of the trim portion 630 is started (S24). The drive of the cut motor allows the cutter unit 631 to move down and the upper blade 633 to move toward a bottom dead center (S25). In such movements, the sheet bundle is successively cut from a rear side according to an edge shape of the upper blade 633. That is, the upper blade 633 starts to move down from a position of the top dead center as illustrated in FIG. 22A, and cuts the sheet bundle by reaching the bottom dead center as illustrated in FIG. 22B. Herein, the scraping sheet 692 of the scraping unit 691 is not moving. However, since the scraping sheet 692 is elastically deformed along the side surface 670 of the upper blade 633, the downward movement of the upper blade 633 is not disturbed by the scraping sheet 692.

Figure 23A:
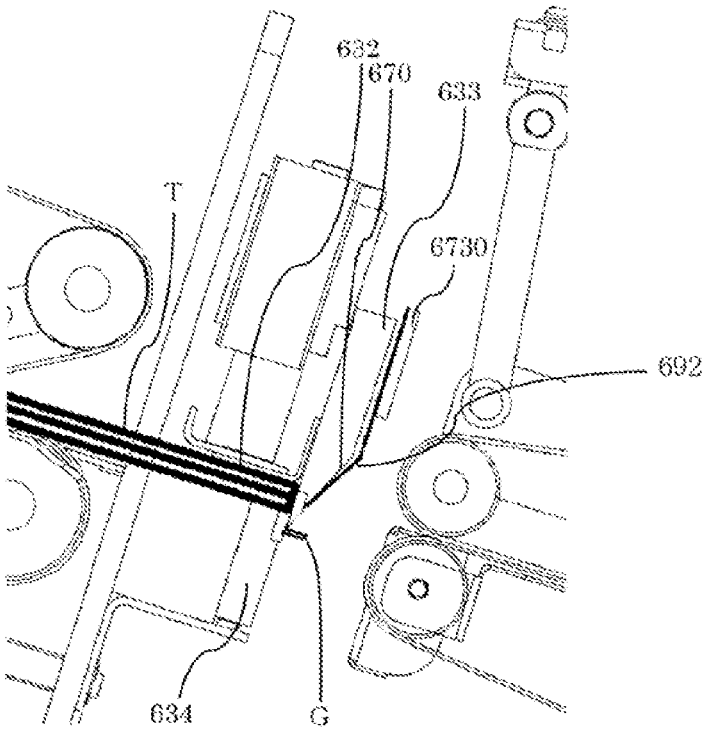
FIGS. 23A and 23B are other diagrams illustrating the operation of the trimmer unit.
Figure 23B:
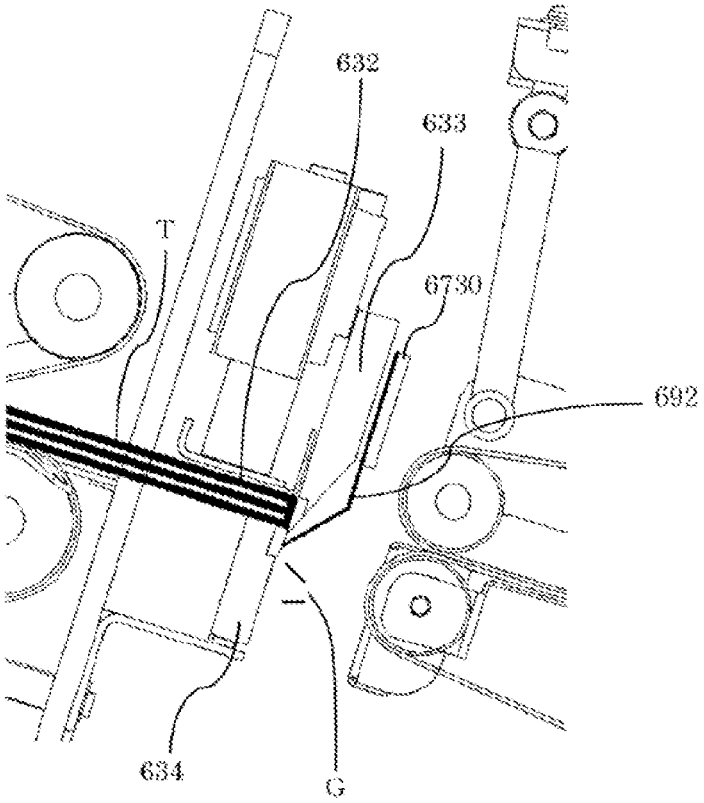

Next, the scraping sheet 692 makes a downward movement while the upper blade 633 is shifting to an upward movement as illustrated in FIG. 23A (S26). Since the scraping sheet 692 is an elastic member, the downward movement is made along the side surface 670 of the upper blade 633. The scraping sheet 692 reaches the lower blade 634 in a state when the upper blade 633 and lower blade 634 overlap each other. That is, the scraping sheet 692 makes a downward movement while extending across the upper blade 633 and the lower blade 634 (S27). Then, the scraping sheet 692 moves toward and reaches the dead center while scraping the cutting waste G to a position below the edge of the upper blade 633. Subsequently, the scraping sheet 692 moves up with the upper blade 633 (S28), and the scraping sheet 692 and the upper blade 633 reach the respective top dead centers as illustrated in FIG. 22A.

When the cutter unit 631 makes a downward movement, a shutter 625 is pressed by a cam 636 to rotate downward so as to open a dropping path for the cutting waste G before a sheet bundle is cut. Herein, the dropping path is opened from a cutting portion including the upper blade 633 and the lower blade 634 to a storage box 635. Thus, the cutting waste G can be reliably stored in the storage box 635 without remaining in the conveying path.

Figure 24:
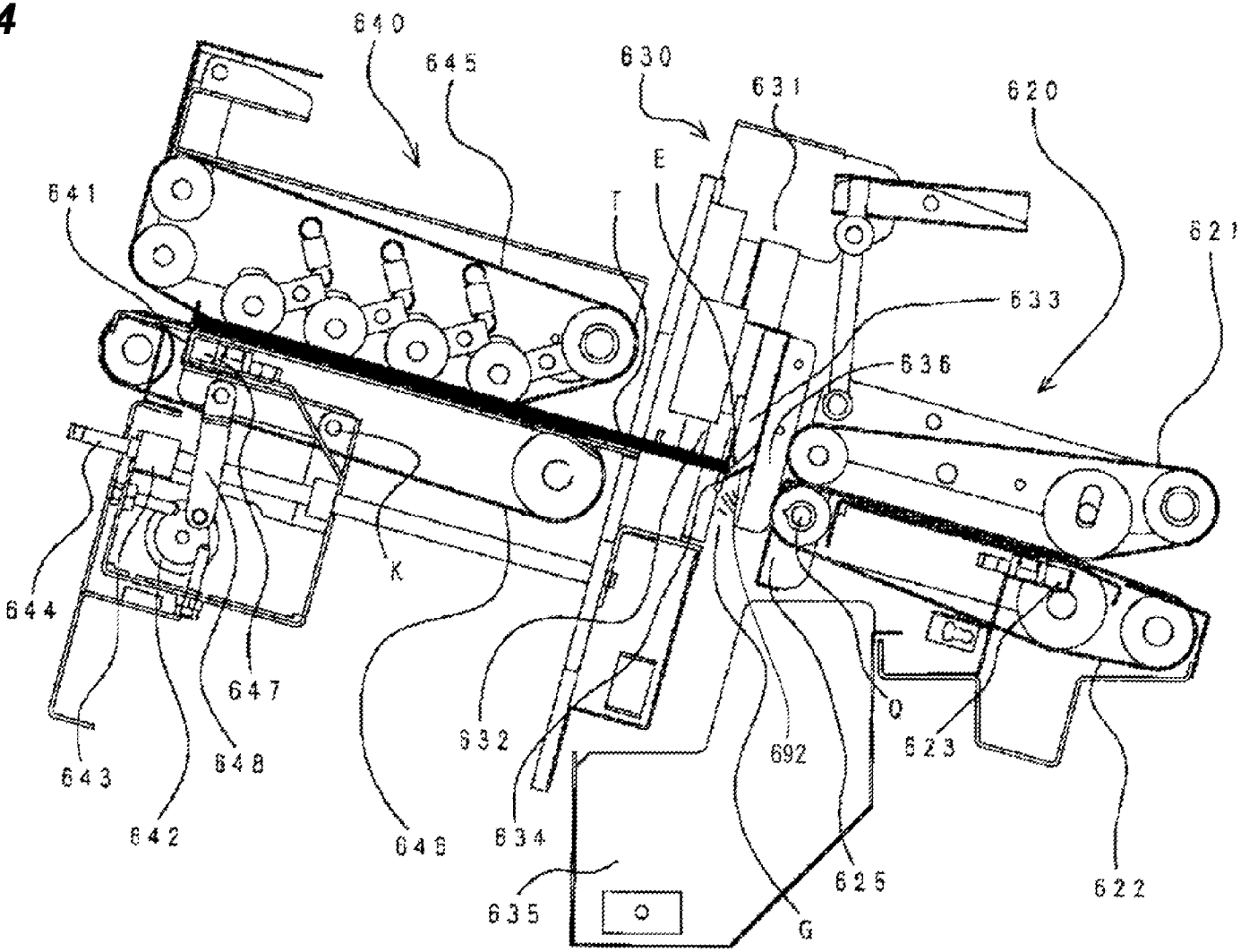
FIG. 24 is a diagram illustrating a state that the cutter unit has reached a bottom dead center.

Next, the cutter unit 631 once stops upon reaching a bottom dead center E in the vicinity of the lowest point in a movable region of the link 637 of FIG. 24. Then, when the cutter unit 631 returns to the initial position as illustrated in FIG. 13 (top dead center U in the vicinity of the highest point in the movable region of the link 637) (Y in S29), the drive of the cut motor stops (S30).

A stopping-time of the cutter unit 631 in the bottom dead center E is set so as to be longer than a bundling time required for the smallest number of sheets in a sheet bundle to be prepared by a saddle stitch bookbinding portion 800. The stop of the cutter unit 631 in the bottom dead center E can ensure the open time of the cutting waste dropping path opened by the shutter 625, so that the cutting waste G is reliably dropped into the storage box 635 as described above.

Since the cam 636 is separated from the shutter 625 when the cutter unit 631 returns to the initial position (top dead center U), the shutter 625 closes the cutting waste dropping path using a twist coil spring. Subsequently, the stopper 641 is retracted (S31), and the drive of each of the second, third, and fourth conveying portions 620, 640, and 650 is turned on to resume the sheet conveyance (S32). The sheet bundle undergoes the cutting process in the trim portion 630 and is conveyed by the third conveying portion 640 to the fourth conveying portion 650 disposed downstream of the third conveying portion 640.

The sheet bundle is further conveyed upward by the fourth conveying portion 650 and is discharged to a discharge portion 660 (S33). The sheet bundles are sequentially discharged and stacked in an imbricated manner on the discharge portion 660. When the sheet bundles are successively conveyed, the similar operation is repeated and the desired number of the sheet bundles is stacked on the discharge portion 660.

According to this embodiment, therefore, the scraping sheet 692 makes a downward movement while extending across the upper blade 633 and the lower blade 634 in a state that these two blades overlap each other, so that the cutting waste can be pressed down to a position below the edge of the upper blade. According to this embodiment, that is, when the sheet bundle is cut, the scraping sheet 692 moves down while elastically pressing the side surface of the upper blade 633 and then moves further down while elastically pressing the side surface of the lower blade 634 in a state that the upper blade 633 is moved down and overlaps with the lower blade 634.

Therefore, such a structure can reduce occurrences of an upward movement of the cutting waste with the upper blade 633 and occurrences of adhesion of the cutting waste to the end portion of the lower blade 634. Such a structure also enables the cutting waste G to be reliably stored in the storage box 635. Moreover, since the movement of the scraping sheet 692 interlocks with the movement of the upper blade 633, an additional drive mechanism is not necessarily disposed and thus a simple structure can be achieved.

According to this embodiment, when the sheet bundle is cut by downward movement of the upper blade 633, the scraping sheet 692 is moved down to a position below the blade edge of the upper blade 633, thereby reducing occurrences of adhesion of the cutting waste to the lower blade 634. Therefore, the cutting waste G does not remain in the conveying path. This can reduce quality deterioration caused by cutting waste which is stacked and held with a sheet bundle and reduce malfunction of a sensor disposed within the conveying path, thereby providing reliable operation.

In this embodiment, the downward movement of the scraping sheet 692 starts when the upper blade 633 reaches the bottom dead center, but is not limited thereto. The scraping sheet 692 and the upper blade 633 may make downward movements simultaneously, so that the scraping sheet 692 may scrape cutting waste while extending across the upper blade 633 and lower blade 634 after a sheet bundle is cut. Moreover, the similar effect may be provided when the cutting waste is scraped by the scraping sheet 692 extending across the upper blade 633 and lower blade 634 while the upper blade 633 and lower blade 634 are overlapping each other after the upper blade 633 reaches the bottom dead center and then makes an upward movement.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-231498, filed Oct. 14, 2010, and No. 2011-201896, filed Sep. 15, 2011, which are hereby incorporated by reference herein in their entirety.

What is claimed is:

1. A sheet processing apparatus which performs a cutting process of cutting a sheet bundle, comprising:

a fixed blade;

a movable blade disposed above the fixed blade, the movable blade being capable of moving up and down and cutting the sheet bundle between the movable blade and the fixed blade in conjunction with the fixed blade; and an adhesion preventing member which prevents cutting waste from adhering to the movable blade and which moves down along the fixed blade to a position below a blade edge of the movable blade after the movable blade cuts the sheet bundle, wherein the adhesion preventing member moves down while elastically pressing against a surface of the movable blade and the fixed blade, when the movable blade cuts the sheet bundle and is in a position lateral to the fixed blade.

2. The sheet processing apparatus according to claim 1, further comprising a conveying portion which conveys the sheet bundle to a position between the movable blade and the fixed blade, wherein the adhesion preventing member is positioned such that the presence of the adhesion preventing member does not alter the conveyance of the sheet bundle by the conveying portion before the movable blade moves down.

3. The sheet processing apparatus according to claim 1, wherein a plurality of the adhesion preventing members is disposed along the blade edge of the movable blade.

4. An image forming apparatus comprising:

an image forming portion which forms an image on a sheet; and a sheet processing apparatus which performs a cutting process cutting a sheet bundle on which the images are formed, the sheet processing apparatus including:

a fixed blade;

a movable blade disposed above the fixed blade, the movable blade being capable of moving up and down and moving down along a side surface of the fixed blade to cut the sheet bundle between the movable blade and the fixed blade; and an adhesion preventing member which prevents cutting waste from adhering to the movable blade and which moves down along the fixed blade to a position below a blade edge of the movable blade after the movable blade cuts the sheet bundle, wherein the adhesion preventing member moves down while elastically pressing against a surface of the movable blade and the fixed blade, when the movable blade cuts the sheet bundle and is in a position lateral to the fixed blade.

5. The image forming apparatus according to claim 4, further comprising a conveying portion which conveys the sheet bundle to a position between the movable blade and the fixed blade, wherein the adhesion preventing member is positioned such that the presence of the adhesion preventing member does not alter the conveyance of the sheet bundle by the conveying portion before the movable blade moves down.

6. The image forming apparatus according to claim 4, wherein a plurality of the adhesion preventing members is disposed along the blade edge of the movable blade.

7. A sheet processing apparatus which performs a cutting process cutting a sheet bundle, comprising:

a fixed blade;

a movable blade disposed above the fixed blade, the movable blade being capable of moving up and down and cutting the sheet bundle between the movable blade and the fixed blade in conjunction with the fixed blade;

an adhesion preventing member which prevents cutting waste from adhering to the movable blade; and a vibrating member which vibrates the adhesion preventing member, wherein after the movable blade cuts the sheet bundle, the vibrating member bends the adhesion preventing member when the adhesion preventing member moves up and vibrates the adhesion preventing member by being released from an abutment with the adhesion preventing member.

8. The sheet processing apparatus according to claim 7, wherein the adhesion preventing member includes a pressing portion which is provided in a position below the blade edge of the movable blade, and integrally moves with the movable blade and presses down the cutting waste, and wherein the pressing portion contacts the sheet bundle and elastically deforms upward before the movable blade contacts the sheet bundle when the movable blade moves down, and moves to a position below the blade edge of the movable blade by an elastic restoring force while pressing the cutting waste after the sheet bundle is cut.

9. The sheet processing apparatus according to claim 8, wherein the pressing portion is provided opposite to a side surface of the fixed blade with a predetermined space therebetween.

10. The sheet processing apparatus according to claim 8, wherein a plurality of the adhesion preventing members are disposed along the blade edge of the movable blade.

11. The sheet processing apparatus according to claim 7, wherein the vibrating member is an elastic member.

12. The image forming apparatus according to claim 7, wherein the adhesion preventing member moves down along the fixed blade to a position below a blade edge of the movable blade after the movable blade cuts the sheet bundle.

13. An image forming apparatus comprising:

an image forming portion which forms an image on a sheet; and a sheet processing apparatus which performs a cutting process of cutting a sheet bundle on which the images are formed, the sheet processing apparatus including:

a fixed blade;

a movable blade disposed above the fixed blade, the movable blade being capable of moving up and down and moving down along a side surface of the fixed blade to cut the sheet bundle between the movable blade and the fixed blade;

an adhesion preventing member which prevents cutting waste from adhering to the movable blade; and a vibrating member which vibrates the adhesion preventing member, wherein after the movable blade cuts the sheet bundle, the vibrating member bends the adhesion preventing member when the adhesion preventing member moves up and vibrates the adhesion preventing member by being released from an abutment with the adhesion preventing member.

14. The image forming apparatus according to claim 13, wherein the adhesion preventing member includes a pressing portion which is provided in a position below the blade edge of the movable blade, and integrally moves with the movable blade and presses down the cutting waste, and wherein the pressing portion contacts the sheet bundle and elastically deforms upward before the movable blade contacts the sheet bundle when the movable blade moves down, and moves to a position below the blade edge of the movable blade by an elastic restoring force while pressing the cutting waste after the sheet bundle is cut.

15. The image forming apparatus according to claim 14, wherein the pressing portion is provided opposite to a side surface of the fixed blade with a predetermined space therebetween.

16. The image forming apparatus according to claim 14, wherein a plurality of the adhesion preventing members are disposed along the blade edge of the movable blade.

17. The image forming apparatus according to claim 13, wherein the vibrating member is an elastic member.

* * * * *